US009487941B2

(12) United States Patent
Grover et al.

(10) Patent No.: US 9,487,941 B2
(45) **Date of Patent: *Nov. 8, 2016**

(54) HIGH PERFORMANCE TOILETS CAPABLE OF OPERATION AT REDUCED FLUSH VOLUMES

(75) Inventors: David Grover, Stockton, NJ (US); Christophe Bucher, Hillsborough, NJ (US); Jian Zhou, Glen Allen, VA (US)

(73) Assignee: AS America, Inc., Piscataway, NJ (US)

( * ) Notice: Subject to any disclaimer, the term of this patent is extended or adjusted under 35 U.S.C. 154(b) by 1064 days.

This patent is subject to a terminal disclaimer.

(21) Appl. No.: 13/182,422

(22) Filed: Jul. 13, 2011

(65) Prior Publication Data

US 2012/0174310 A1 Jul. 12, 2012

Related U.S. Application Data

(63) Continuation-in-part of application No. 12/392,931, filed on Feb. 25, 2009, now Pat. No. 8,316,475.

(60) Provisional application No. 61/366,146, filed on Jul. 20, 2010, provisional application No. 61/067,032, filed on Feb. 25, 2008.

(51) Int. Cl.
*E03D 11/00* (2006.01)
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC ..... E03D 11/08
USPC ..... 4/332, 336, 374, 415, 420, 425, 428, 4/421
See application file for complete search history.

(56) References Cited

U.S. PATENT DOCUMENTS 1,435,644 A 11/1922 Kelly
1,742,790 A 1/1930 Smith
(Continued)

FOREIGN PATENT DOCUMENTS

CN 2421344 Y 2/2001
CN 1322268 A 11/2001
(Continued)

OTHER PUBLICATIONS

PCT International Search Report and Written Opinion dated Apr. 16, 2009 issued in PCT/US2009/035186 having common priority (9 pages).
(Continued)

*Primary Examiner* — Tuan N Nguyen
(74) *Attorney, Agent, or Firm* — Flaster/Greenberg P.C.

(57) ABSTRACT

Siphonic, gravity-powered toilets are provided that include a toilet bowl assembly having a toilet bowl. The toilet bowl has a rim channel provided along an upper periphery thereof and a direct-fed jet channel that allows fluid, such as water, to flow from the inlet of the toilet bowl assembly to the direct-fed jet outlet port into the interior of the toilet bowl, in the sump of the bowl. The rim channel includes at least one rim channel outlet port. In the toilets herein, the cross-sectional areas of the toilet bowl assembly inlet, the inlet port to the rim channel, and the outlet port to the direct-fed jet channel are configured so as to be optimized to provide greatly improved hydraulic function at low flush volumes (no greater than about 6.0 liters per flush). The hydraulic function is improved in terms of bulk removal of waste and cleansing of the bowl.

39 Claims, 21 Drawing Sheets

(56) References Cited

U.S. PATENT DOCUMENTS

| | | | | |
|---|---|---|---|---|
| 1,821,300 | A | 9/1931 | Gavin | |
| 1,973,349 | A | 9/1934 | Kruse | |
| 2,071,790 | A | 2/1937 | Groeniger | |
| 2,116,528 | A | 5/1938 | McNeil | |
| 2,703,409 | A | 3/1955 | Manning et al. | |
| 3,224,013 | A | 12/1965 | Tubbs et al. | |
| 4,143,430 | A | 3/1979 | Joshi et al. | |
| 4,462,124 | A | 7/1984 | Antos et al. | |
| 4,987,616 | A | 1/1991 | Ament | |
| 5,054,133 | A | 10/1991 | Pickerrell et al. | |
| 5,218,726 | A | 6/1993 | Jaeckels | |
| 5,283,913 | A | 2/1994 | Jaeckels | |
| 5,502,845 | A | 4/1996 | Hayashi et al. | |
| 5,579,542 | A | 12/1996 | Hayman | |
| 5,651,148 | A | 7/1997 | Bayot | |
| 5,819,326 | A | 10/1998 | Kobayashi et al. | |
| 5,887,294 | A | 3/1999 | Yeung | |
| 5,918,325 | A | 7/1999 | Arita et al. | |
| 5,926,863 | A * | 7/1999 | Arita et al. | 4/425 |
| 5,983,413 | A | 11/1999 | Hayashi | |
| 6,115,853 | A | 9/2000 | Shibata et al. | |
| 6,219,855 | B1 | 4/2001 | Hsu | |
| 6,247,192 | B1 | 6/2001 | Bostoen | |
| 6,467,101 | B1 | 10/2002 | Artola | |
| 6,502,251 | B1 | 1/2003 | Teshimu et al. | |
| 6,571,400 | B1 | 6/2003 | Reid | |
| 6,715,162 | B2 | 4/2004 | Han et al. | |
| 6,782,564 | B1 | 8/2004 | Cheng | |
| 6,823,535 | B2 | 11/2004 | Tomita et al. | |
| 6,928,666 | B1 | 8/2005 | Schaffer | |
| 7,111,333 | B1 | 9/2006 | Lo et al. | |
| 7,325,258 | B2 | 2/2008 | Asada et al. | |
| 8,032,956 | B2 | 10/2011 | Prokopenko et al. | |
| 8,151,379 | B2 | 4/2012 | Mueller et al. | |
| 8,316,475 | B2 * | 11/2012 | Grover | 4/332 |
| 2003/0115664 | A1 | 6/2003 | Kosugi et al. | |
| 2003/0213055 | A1 | 11/2003 | Yoneda et al. | |
| 2004/0040080 | A1 | 3/2004 | Prokopenko et al. | |
| 2005/0000007 | A1 | 1/2005 | Cummings | |
| 2005/0268391 | A1 | 12/2005 | Reichmuth et al. | |
| 2006/0096017 | A1 | 5/2006 | Yamasaki et al. | |
| 2006/0260033 | A1 | 11/2006 | Preston | |
| 2007/0113331 | A1 | 5/2007 | Prokopenko et al. | |
| 2009/0007323 | A1 | 1/2009 | Campbell et al. | |
| 2009/0241250 | A1 | 10/2009 | Grover | |
| 2010/0043130 | A1 | 2/2010 | Grover et al. | |

FOREIGN PATENT DOCUMENTS

| | | | |
|---|---|---|---|
| JP | H1-89900 | U | 6/1989 |
| JP | H03-29572 | U | 7/1989 |
| JP | 06-010397 | A | 1/1994 |
| JP | 06-185102 | A | 7/1994 |
| JP | 2001-220805 | A | 8/2001 |
| JP | 2001-271407 | A | 10/2001 |
| WO | WO 2009108727 | A1 | 9/2009 |

OTHER PUBLICATIONS

PCT International Preliminary Report on Patentability dated Aug. 31, 2010 issued in PCT/US2009/035186 having common priority (8 pages).

PCT International Search Report, PCT International No. PCT/US2011/043924, Dated Dec. 16, 2011, 2 pages PCT International Preliminary Report on Patentability, dated Jan. 22, 2013 (7 pages).

Australian Notice of Acceptance dated Jun. 14, 2013 in Australian Appln. No. 2009219339 (counterpart of parent U.S. Appl. No. 12/392,931) (3 pages).

Australian Office Action in Australian Divisional Application No. 2013231176 dated Jun. 16, 2015 (counterpart of parent U.S. Appl. No. 12/392,931 (3 pages).

Australian Office Action Response in divisional Application 2013231176 dated Dec. 2, 2015 (41 pages) (now granted).

Canadian Office Action dated Mar. 5, 2015 in Canadian Application No. 2699994 (counterpart of parent application) and Response Filed.

Canadian Office Action Response dated Sep. 4, 2015 in Canadian Appln. No. 269994 (counterpart of parent application) and Allowance.

Chinese Office Action dated Oct. 25, 2011 (English Translation), issued in Application No. 200980100544.2 (counterpart of parent U.S. Appl. No. 12/392,931)(4 pages) and Response to Chinese Office Action dated May 9, 2012 (English Translation), in Application No. 200980100544.2 (counterpart of parent U.S. Appl. No. 12/392,931(3 pages) (now granted).

Chinese Divisional Office Action dated Nov. 14, 2013 in Chinese Application 201210142581.3 (17 pages) (counterpart of parent U.S. Appl. No. 12/392,931 and Response (in Chinese only) 9 pages.

Chinese Divisional Second Office Action (translation) dated Jul. 9, 2014 in Chinese Application No. 200980100544.2 (counterpart of parent U.S. Appl. No. 12/392,931) and Response (in Chinese only) (7 pages) (granted).

Chinese Office Action (in Chinese only) for Chinese Application 201180009654.0 dated Nov. 20, 2013 (10 pages) and Response (with English translation) dated Jun. 5, 2014 (25 pages) Counterpart of pending U.S. Appl. No. 13/182,422.

Chinese 2$^{nd}$ Office Action (with translation) for Chinese Application 201180009654.0 dated Sep. 11, 2014 (25 pages) and Response filed Jan. 26, 2015 (28 pages)(in Chinese with English claims) Counterpart of pending U.S. Appl. No. 13/182,422.

Chinese 3$^{rd}$ Office Action (in Chinese with partial English version) dated May 15, 2015 in Chinese Appln. 201180009654.0 and English Translation of Response as filed (20 pages) (Counterpart of pending U.S. Appl. No. 13/182,422.

Chinese 4$^{th}$ Office Action (in Chinese with English Translation) dated Feb. 1, 2016 in Chinese Appln. 201180009654.0 (7 pages).

Colombian Opposition (English Translation), filed by Ceramica Italia S.A., issued in Application No. 10 118.688 (counterpart of parent U.S. Appl. No. 12/392,931) (71 pages) and Response to Colombian Opposition dated Apr. 24, 2012 (English Translation), issued in Application No. 10 118.688 (counterpart of parent U.S. Appl. No. 12/392,931)(4 pages).

Colombian Office Action (English Translation) in Colombian Appln. 10 118 688 (counterpart of parent U.S. Appl. No. 12/392,931) due Jun. 26, 2013 (5 pages) and Response and English Translation of Jun. 28, 2013 (34 pages total).

Colombian Patent Office Communication (with translation) in Colombian Appln. 10 118 688 (counterpart of parent U.S. Appl. No. 12/392,931) Sep. 24, 2013 and Appeal as Filed (with translation) (23 pages).

Colombian Appeal filed Oct. 31, 2013 (no translation) and Appeal Decision (and translation) dated May 20, 2014 in Colombian Appln. 10 118 688 (counterpart of parent U.S. Appl. No. 12/392,931) (20 pages total) and patented claims after appeal.

Japanese Office Action Feb. 26, 2013 (translation) (3 pages) and Response as filed Oct. 1, 2014 (in Japanese) with English Claims (16 pages) in Japanese Application No. 2010-548848 (counterpart of parent U.S. Appl. No. 12/392,931 (16 pages).

Japanese Second Office Action Apr. 1, 2014 (translation) and Response as filed (with translation) in Japanese Application No. 2010-548848 (counterpart of parent U.S. Appl. No. 12/392,931 (17 pages) (now granted).

Japanese Office Action Aug. 15, 2015 (and translation) and Response as filed (with translation of amended claims) in Japanese Application No. 2015-029867 (counterpart of pending U.S. Appl. No. 13/182,422) (18 pages) (now granted).

Korean 1$^{st}$ Office Action Jun. 25, 2015 (and translation) in Korean Application No. 10-2010-046937-3 (counterpart of parent U.S. Appl. No. 12/392,931 (15 pages).

Korean 1$^{st}$ Office Action Response filed Nov. 26, 2015 (and translation in Korean Application 10-2010-046937-3 (counterpart of parent U.S. Appl. No. 12/392,931 (36pages)(now granted).

Mexican Office Action of Aug. 23, 2012 in MX/a/2010003447 (counterpart of parent U.S. Appl. No. 12/392,931)(2 pages) and Response to Mexican Office Action dated Jan. 9, 2013 (15 pages) (granted).

(56) References Cited

OTHER PUBLICATIONS

Mexican First Office Action dated Sep. 17, 2014 in MX/a/2012/009487 (4 pages)(in Spanish only) and Response as filed Feb. 9, 2015 (with English translation (37 pages) Counterpart of pending U.S. Appl. No. 13/182,422.

Mexican 2nd Office Action on May 13, 2015 in MX/a/2012/009487 (counterpart of pending U.S. Appl. No. 13/182,422 (4 pages) (in Spanish) and Response as filed with Translation (35 pages).

Mexican 3rd Office Action of Nov. 11, 2015 (Spanish) (6pages) (counterpart of Pending U.S. Appl. No. 13/182,422 and Response as filed Apr. 4, 2016 with translation.

Plaintiff Patentee's Complaint from *American Standard* v. *Masco Litigation*, Civ. Action. No. 3:13-cv-00005-MAS-DEA, Jan. 2, 2003 involving parent U.S. Pat. No. 8,316,475 (39 pages).

Defendant Answer and Counterclaim from *American Standard* v. *Masco Litigation*, Civ. Action. No. 3:13-cv-00005-MAS-DEA, Jan. 2, 2003 involving parent U.S. Pat. No. 8,316,475 Feb. 20, 2013, (8 pages).

Plaintiff Response to Counterclaims from *American Standard* v. *Masco Litigation*, Civ. Action. No. 3:13-cv-00005-MAS-DEA, Jan. 2, 2003 involving parent U.S. Pat. No. 8,316,475 Mar. 8, 2013 (3 pages).

Defendant's First Invalidity Contentions in *American Standard* v. *Masco Litigation*, Civ. Action. No. 3:13-cv-00005-MAS-DEA, Jan. 2, 2003 involving parent U.S. Pat. No. 8,316,475, Jun. 17, 2013 (8 pages plus 114 pages exhibits).

Defendant's Supplemental invalidity Contentions in *American Standard* v. *Masco Litigation*, Civ. Action. No. 3:13-cv-00005-MAS-DEA, Jan. 2, 2003 involving parent U.S. Pat. No. 8,316,475, Jul. 2, 2013 (11 pages plus 309 pages exhibits).

Defendant's Motion for Leave to Amend Invalidity Contentions in *American Standard* v. *Masco Litigation*, Civ. Action. No. 3:13-cv-00005-MAS-DEA, Jan. 2, 2003 involving parent U.S. Pat. No. 8,316,475 (20 pages plus 183 pages affidavit and exhibits).

Plaintiff Patentee's Opposition to Motion to Amend Invalidity Contentions in *American Standard* v. *Masco Litigation*, Civ. Action. No. 3:13-cv-00005-MAS-DEA, Jan. 2, 2003 involving parent U.S. Pat. No. 8,316,475 (12 pages plus 54 pages affidavit and exhibits).

Defendant's Reply to Opposition to Motion to Amend Invalidity Contentions in *American Standard* v. *Masco Litigation*, Civ. Action. No. 3:13-cv-00005-MAS-DEA, Jan. 2, 2003 involving parent U.S. Pat. No. 8,316,475 (14 pages plus 27 pages affidavit and exhibits).

Plaintiff's Motion for Leave to File Surreply and Surreply in *American Standard* v. *Masco Litigation*, Civ. Action. No. 3:13-cv-00005-MAS-DEA, Jan. 2, 2003 involving parent U.S. Pat. No. 8,316,475 (13 pages plus 37 pages affidavits and exhibits).

Court Order and Memorandum Granting Motion *American Standard* v. *Masco Litigation*, Civ. Action. No. 3:13-cv-00005-MAS-DEA, Jan. 2, 2003 involving parent U.S. Pat. No. 8,316,475 Aug. 13, 2013, (11pages).

Defendant's Amended Supplemental Invalidity Contentions in *American Standard* v. *Masco Litigation*, Civ. Action. No. 3:13-cv-00005-MAS-DEA, Jan. 2, 2003 involving parent U.S. Pat. No. 8,316,475 (15 pages plus 40 pages exhibits).

Plaintiff Patentee's Responses to Defendant's Invalidity Contentions *American Standard* v. *Masco Litigation*, Civ. Action. No. 3:13-cv-00005-MAS-DEA, Jan. 2, 2003 involving parent U.S. Pat. No. 8,316,475, Sep. 20, 2013 (6 pages plus 80 pages claim charts and exhibits).

Dismissal Stipulation and Dismissal Order May 22, 2014 and May 14, 2014 (2 pages).

* cited by examiner

Rim Pressure (Trapway 2: Normal height, 2.0625 in Trapway diameter)

Rim Pressure (Trapway 5: Right height, 2.0625 in Trapway diameter)

HIGH PERFORMANCE TOILETS CAPABLE OF OPERATION AT REDUCED FLUSH VOLUMES

CROSS-REFERENCE TO RELATED APPLICATIONS

This patent application claims the benefit under 35 U.S.C. §119(e) of U.S. Provisional Patent Application No. 61/366,146, filed Jul. 20, 2010. This application is also a continuation-in-part of U.S. Non-Provisional patent application Ser. No. 12/392,931 filed Feb. 25, 2009, which claims the benefit under 35 U.S.C. §119(e) of U.S. Provisional Patent Application No. 61/067,032 filed Feb. 25, 2008. The entire disclosures of each of the above-noted U.S. applications are incorporated herein by reference.

BACKGROUND OF THE INVENTION

1. Field of the Invention

The present invention relates to the field of gravity-powered toilets for removal of human and other waste. The present invention further relates to the field of toilets that can be operated at reduced water volumes.

2. Description of Related Art

Toilets for removing waste products, such as human waste, are well known. Gravity powered toilets generally have two main parts: a tank and a bowl. The tank and bowl can be separate pieces which are coupled together to form the toilet system (commonly referred to as a two-piece toilet) or can be combined into one integral unit (typically referred to as a one-piece toilet).

The tank, which is usually positioned over the back of the bowl, contains water that is used for initiating flushing of waste from the bowl to the sewage line, as well as refilling the bowl with fresh water. When a user desires to flush the toilet, he pushes down on a flush lever on the outside of the tank, which is connected on the inside of the tank to a movable chain or lever. When the flush lever is depressed, it moves a chain or lever on the inside of the tank which acts to lift and open the flush valve, causing water to flow from the tank and into the bowl, thus initiating the toilet flush.

There are three general purposes that must be served in a flush cycle. The first is the removal of solid and other waste to the drain line. The second is cleansing of the bowl to remove any solid or liquid waste which was deposited or adhered to the surfaces of the bowl, and the third is exchanging the pre-flush water volume in the bowl so that relatively clean water remains in the bowl between uses. The second requirement, cleansing of the bowl, is usually achieved by way of a hollow rim that extends around the upper perimeter of the toilet bowl. Some or all of the flush water is directed through this rim channel and flows through openings positioned therein to disperse water over the entire surface of the bowl and accomplish the required cleansing.

Gravity powered toilets can be classified in two general categories: wash down and siphonic. In a wash-down toilet, the water level within the bowl of the toilet remains relatively constant at all times. When a flush cycle is initiated, water flows from the tank and spills into the bowl. This causes a rapid rise in water level and the excess water spills over the weir of the trapway, carrying liquid and solid waste along with it. At the conclusion of the flush cycle, the water level in the bowl naturally returns to the equilibrium level determined by the height of the weir.

In a siphonic toilet, the trapway and other hydraulic channels are designed such that a siphon is initiated in the trapway upon addition of water to the bowl. The siphon tube itself is an upside down U-shaped tube that draws water from the toilet bowl to the wastewater line. When the flush cycle is initiated, water flows into the bowl and spills over the weir in the trapway faster than it can exit the outlet to the sewer line. Sufficient air is eventually removed from the down leg of the trapway to initiate a siphon which in turn pulls the remaining water out of the bowl. The water level in the bowl when the siphon breaks is consequently well below the level of the weir, and a separate mechanism needs to be provided to refill the bowl of the toilet at the end of a siphonic flush cycle to reestablish the original water level and protective "seal" against back flow of sewer gas.

Siphonic and wash-down toilets have inherent advantages and disadvantages.

Siphonic toilets, due to the requirement that most of the air be removed from the down leg of the trapway in order to initiate a siphon, tend to have smaller trapways which can result in clogging. Wash-down toilets can function with large trapways but generally require a smaller amount of pre-flush water in the bowl to achieve the 100:1 dilution level required by plumbing codes in most countries (i.e., 99% of the pre-flush water volume in the bowl must be removed from the bowl and replaced with fresh water during the flush cycle). This small pre-flush volume manifests itself as a small "water spot." The water spot, or surface area of the pre-flush water in the bowl, plays an important role in maintaining the cleanliness of a toilet. A large water spot increases the probability that waste matter will contact water before contacting the ceramic surface of the toilet. This reduces adhesion of waste matter to the ceramic surface making it easier for the toilet to clean itself via the flush cycle. Wash-down toilets with their small water spots therefore frequently require manual cleaning of the bowl after use.

Siphonic toilets have the advantage of being able to function with a greater pre-flush water volume in the bowl and greater water spot. This is possible because the siphon action pulls the majority of the pre-flush water volume from the bowl at the end of the flush cycle. As the tank refills, a portion of the refill water is directed into the bowl to return the pre-flush water volume to its original level. In this manner, the 100:1 dilution level required by many plumbing codes is achieved even though the starting volume of water in the bowl is significantly higher relative to the flush water exited from the tank. In the North American markets, siphonic toilets have gained widespread acceptance and are now viewed as the standard, accepted form of toilet. In European markets, wash-down toilets are still more accepted and popular. Whereas both versions are common in the Asian markets.

Gravity powered siphonic toilets can be further classified into three general categories depending on the design of the hydraulic channels used to achieve the flushing action. These categories are: non-jetted, rim jetted, and direct jetted.

In non-jetted bowls, all of the flush water exits the tank into a bowl inlet area and flows through a primary manifold into the rim channel. The water is dispersed around the perimeter of the bowl via a series of holes positioned underneath the rim. Some of the holes are designed to be larger in size to allow greater flow of water into the bowl. A relatively high flow rate is needed to spill water over the weir of the trapway rapidly enough to displace sufficient air in the down leg and initiate a siphon. Non-jetted bowls typically have adequate to good performance with respect to cleansing of the bowl and exchange of the pre-flush water, but are relatively poor in performance in terms of bulk removal. The feed of water to the trapway is inefficient and turbulent, which makes it more difficult to sufficiently fill the down leg of the trapway and initiate a strong siphon. Consequently, the trapway of a non-jetted toilet is typically smaller in diameter and contains bends and constrictions designed to impede flow of water. Without the smaller size, bends, and constrictions, a strong siphon would not be achieved. Unfortunately, the smaller size, bends, and constrictions result in poor performance in terms of bulk waste removal and frequent clogging, conditions that are extremely dissatisfying to end users.

Designers and engineers of toilets have improved the bulk waste removal of siphonic toilets by incorporating "siphon jets." In a rim-jetted toilet bowl, the flush water exits the tank, flows through the manifold inlet area and through the primary manifold into the rim channel. A portion of the water is dispersed around the perimeter of the bowl via a series of holes positioned underneath the rim. The remaining portion of water flows through a jet channel positioned at the front of the rim. This jet channel connects the rim channel to a jet opening positioned in the sump of the bowl. The jet opening is sized and positioned to send a powerful stream of water directly at the opening of the trapway. When water flows through the jet opening, it serves to fill the trapway more efficiently and rapidly than can be achieved in a non jetted bowl. This more energetic and rapid flow of water to the trapway enables toilets to be designed with larger trapway diameters and fewer bends and constrictions, which, in turn, improves the performance in bulk waste removal relative to non-jetted bowls. Although a smaller volume of water flows out of the rim of a rim jetted toilet, the bowl cleansing function is generally acceptable as the water that flows through the rim channel is pressurized. This allows the water to exit the rim holes with higher energy and do a more effective job of cleansing the bowl.

Although rim-jetted bowls are generally superior to non-jetted, the long pathway that the water must travel through the rim to the jet opening dissipates and wastes much of the available energy. Direct-jetted bowls improve on this concept and can deliver even greater performance in terms of bulk removal of waste. In a direct-jetted bowl, the flush water exits the tank and flows through the bowl inlet and through the primary manifold. At this point, the water is divided into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl. The direct jet channel can take different forms, sometimes being unidirectional around one side of the toilet, or being "dual fed," wherein symmetrical channels travel down both sides connecting the manifold to the jet opening. As with the rim jetted bowls, the jet opening is sized and positioned to send a powerful stream of water directly at the opening of the trapway. When water flows through the jet opening, it serves to fill the trapway more efficiently and rapidly than can be achieved in a non-jetted or rim jetted bowl. This more energetic and rapid flow of water to the trapway enables toilets to be designed with even larger trapway diameters and minimal bends and constrictions, which, in turn, improves the performance in bulk waste removal relative to non-jetted and rim jetted bowls.

Several inventions have been aimed at improving the performance of siphonic toilets through optimization of the direct jetted concept. For example, in U.S. Pat. No. 5,918,325, performance of a siphonic toilet is improved by improving the shape of the trapway. In U.S. Pat. No. 6,715,162, performance is improved by the use of a flush valve with a radius incorporated into the inlet and asymmetrical flow of the water into the bowl.

Although direct fed jet bowls currently represent the state of the art for bulk removal of waste, there are still major needs for improvement. Government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush). Regulations have recently been passed in the State of California which require water usage to be lowered ever further to 1.28 gallons/flush (4.8 liters/flush). The 1.6 gallons/flush toilets currently described in the patent literature and available commercially lose the ability to consistently siphon when pushed to these lower levels of water consumption. Thus, manufacturers will be forced to reduce trapway diameters and sacrifice performance unless improved technology and toilet designs are developed.

A second, related area that needs to be addressed is the development of siphonic toilets capable of operating with dual flush cycles. "Dual flush" toilets are designed to save water through incorporation of mechanisms that enable different water usages to be chosen depending on the waste that needs to be removed. For example, a 1.6 gallon per flush cycle could be used to remove solid waste and a 1.2 gallon or below cycle used for liquid waste. Prior art toilets generally have difficultly siphoning on 1.2 gallons or lower. Thus, designers and engineers reduce the trapway size to overcome this issue, sacrificing performance at the 1.6 gallon cycle needed for solid waste removal.

A third area that needs to be improved is the bowl cleansing ability of direct jetted toilets. Due to the hydraulic design of direct jetted bowls, the water that enters the rim channel is not pressurized. Rather, it spills into the rim channel only after the jet channel is filled and pressurized. The result is that the water exiting the rim has very low energy and the bowl cleansing function of direct jet toilets is generally inferior to rim jetted and non-jetted.

Therefore, there is a need in the art for a toilet which overcomes the above noted deficiencies in prior art toilets, which is not only resistant to clogging, but allows for sufficient cleansing during flushing, while allowing for compliance with water conservation standards and government guidelines.

BRIEF SUMMARY OF THE INVENTION

The present invention relates to gravity powered toilets for the removal of human and other waste, which can be operated at reduced water volumes without diminishment in the toilets' ability to remove waste and cleanse the toilet bowl.

Advantages of various embodiments of the present invention include, but are not limited to providing a toilet that avoids the aforementioned disadvantages of the prior art, is resistant to clogging, and provides a direct fed jet toilet with a more effective, pressurized rim wash. In doing so, embodiments of the present invention can provide a toilet with a more powerful direct jet that takes full advantage of the potential energy available to it. In embodiments herein, the toilet eliminates the need for the user to initiate multiple flush cycles to achieve a clean bowl.

The present invention can provide a toilet which is self-cleaning, and also provide all of the above-noted advantages at water usages below 1.6 gallons per flush, preferably below 1.28 gallons per flush, and as low as 0.75 gallons per flush or lower.

Embodiments of the current invention provide a siphonic toilet suitable for operation in a "dual flush" mode, without significant compromise in trapway size.

The present invention may also provide a toilet with a hydraulically-tuned, direct jet path for greater performance and/or provide a toilet which reduces hydraulic losses.

In accordance with an embodiment of the present invention, a new and improved toilet of the siphonic, gravity-powered type is provided which includes a toilet bowl assembly having a toilet bowl in fluid communication with a sewage outlet, such as through a trapway extending from a bottom sump outlet of the toilet bowl to a sewage line. The toilet bowl has a rim along an upper perimeter thereof that accommodates a sustained pressurized flow of flush water through at least one opening in the rim for cleansing the bowl. Flow enters the rim channel and jet channel(s) in a direct-fed jet, while providing sustained pressurized flow out of the rim. The pressure is generally simultaneously maintained in the rim and jet channels by maintaining the relative cross-sectional areas of specific features of the internal hydraulic pathway within certain defined limits. Bulk waste removal performance and resistance to clogging is maintained at lower water usages because applicants have discovered that pressurization of the rim provides for a stronger and longer jet flow, which enables a larger trapway to be filled without loss of siphoning capability.

In accordance with the foregoing, in one embodiment, the invention includes a siphonic, gravity-powered toilet having a toilet bowl assembly, the toilet bowl assembly comprising a toilet bowl assembly inlet in fluid communication with a source of fluid, a toilet bowl having a rim around an upper perimeter thereof and defining a rim channel, the rim having an inlet port and at least one rim outlet port, wherein the rim channel inlet port is in fluid communication with the toilet bowl assembly inlet, a bowl outlet in fluid communication with a sewage outlet, and a direct-fed jet in fluid communication with the toilet bowl assembly inlet for receiving fluid from the source of fluid and the bowl outlet for discharging fluid, wherein the toilet is capable of operating at a flush volume of no greater than about 6.0 liters and the water exiting the at least one rim outlet port is pressurized such that an integral of a curve representing rim pressure plotted against time during a flush cycle for a flush volume of about 6.0 liters exceeds 3 in. $H_2O$·s. In preferred embodiments, the toilet is capable of operating at a flush volume of no greater than about 4.8 liters and the water exiting the at least one rim outlet port is pressurized such that an integral of a curve representing rim pressure plotted against time during a flush cycle for a flush volume of about 4.8 liters exceeds 3 in. $H_2O$·s.

The at least one rim outlet port is preferably pressurized in a sustained manner for a period of time, for example for at least 1 second. The toilet is preferably capable of providing the sustained pressurized flow from the at least one rim outlet port generally simultaneously with flow through the direct-fed jet. Also, it is preferred that an integral of a curve representing rim pressure plotted against time during a flush cycle using a preferred embodiment of the toilet herein exceeds 5 in. $H_2O$·s for a flush volume of about 6.0 liters. In addition, in preferred embodiments, the toilet is capable of operating at a flush volume of not greater than about 4.8 liters and rim pressure plotted against time during a flush cycle using a preferred embodiment of the toilet herein exceeds 3 in. $H_2O$·s for a flush volume of about 4.8 liters In yet a further embodiment, the toilet bowl assembly further comprises a primary manifold in fluid communication with the toilet bowl assembly inlet capable of receiving fluid from the toilet bowl assembly inlet, the primary manifold also in fluid communication with the rim channel and the direct-fed jet for directing fluid from the toilet bowl assembly inlet to the rim channel and the direct-fed jet, wherein the primary manifold has a cross-sectional area ($A_{pm}$); wherein the direct-fed jet has an inlet port having a cross-sectional area ($N_{jip}$) and an outlet port having a cross-sectional area ($A_{jop}$) and further comprises a jet channel extending between the direct-fed jet inlet port and the direct-fed jet outlet port; and wherein the rim channel has an inlet port having a cross-sectional area ($A_{rip}$) and the at least one outlet port has a total cross-sectional area ($A_{rop}$), wherein:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

In one preferred embodiment, the cross-sectional area of the primary manifold is greater than or equal to about 150% of the sum of the cross-sectional area of the direct-fed jet outlet port and the total cross-sectional area of the at least one rim outlet port, and more preferably the cross-sectional area of the rim inlet port is greater than or equal to about 250% of the total cross-sectional area of the at least one rim outlet port.

In other embodiments, the toilet may further comprise a mechanism that enables operation of the toilet using at least two different flush volumes.

The toilet bowl assembly may have a longitudinal axis extending in a direction transverse to a plane defined by the rim of the toilet bowl, wherein the primary manifold extends in a direction generally transverse to the longitudinal axis of the toilet bowl.

The invention further includes in another embodiment a siphonic, gravity-powered toilet having a toilet bowl assembly, the toilet bowl assembly comprising a toilet bowl assembly inlet in communication with a fluid source, a toilet bowl defining an interior space therein for receiving fluid, a rim extending along an upper periphery of the toilet bowl and defining a rim channel, wherein the rim has a rim channel inlet port and at least one rim channel outlet port, wherein the rim channel inlet port is in fluid communication with the toilet bowl assembly inlet and the at least one rim channel outlet port is configured so as to allow fluid flowing through the rim channel to enter the interior space of the toilet bowl, a bowl outlet in fluid communication with a sewage outlet and a direct-fed jet having an inlet port and an outlet port, wherein the direct-fed jet inlet port is in fluid communication with the toilet bowl assembly inlet for introducing fluid into a lower portion of the interior of the bowl, wherein the toilet bowl assembly is configured so that the rim channel and the direct-fed jet are capable of introducing fluid into the bowl in a sustained pressurized manner. In preferred embodiments, this toilet is achieves the above-noted pressurized introduction of fluid at flush volumes of 6.0 liters and more preferably at 4.8 liters.

In one preferred embodiment, the toilet bowl assembly further comprises a primary manifold in fluid communication with the toilet bowl assembly inlet capable of receiving fluid from the toilet bowl assembly inlet, and the primary manifold also in fluid communication with the inlet port of the rim channel and the inlet port of the direct-fed jet for directing fluid from the toilet bowl assembly inlet to the rim channel and to the direct-fed jet, wherein the primary manifold has a cross-sectional area ($A_{pm}$); wherein the inlet port of the direct-fed jet has a cross-sectional area ($A_{jip}$) and the outlet port of the direct-fed jet has a cross-sectional area ($A_{jop}$); and wherein the inlet port of the rim channel has a cross-sectional area ($A_{rip}$) and the at least one outlet port has a total cross-sectional area ($A_{rop}$), wherein:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

Preferably, the cross-sectional area of the primary manifold is greater than or equal to about 150% of the sum of the cross-sectional area of the direct-fed jet outlet port and the total cross-sectional area of the at least one rim outlet port, and more preferably the cross-sectional area of the rim inlet port is greater than or equal to about 250% of the total cross-sectional area of the at least one rim outlet port.

In addition, in a preferred embodiment of the above-noted siphonic, gravity-powered toilet $A_{pm}$ may be about 3 to about 20 square inches, more preferably about 3.5 to about 15 square inches, $A_{jip}$ may be about 2.5 to about 15 square inches, more preferably about 4 to about 12 square inches, $A_{jop}$ may be about 0.6 to about 5 square inches, more preferably about 0.85 to about 3.5 square inches, $A_{rip}$ may be about 1.5 to about 15 square inches, more preferably about 2 to about 12 square inches, and $A_{rop}$ may be about 0.3 to about 5 square inches, more preferably about 0.4 to about 4 square inches. Further, $A_{pm}/(A_{rop}+A_{jop})$ may be about 150% to about 2300%, more preferably about 150% to about 1200% and $A_{rip}/A_{rop}$ may be about 250% to about 5000%, more preferably about 250% to about 3000%.

The toilet may further comprise a mechanism in certain embodiments that enables operation of the toilet using at least two different flush volumes.

The invention further includes in an embodiment, in a siphonic, gravity-powered toilet having a toilet bowl assembly, the assembly comprising a toilet bowl, a direct-fed jet and a rim defining a rim channel and having at least one rim opening, wherein fluid is introduced into the bowl through the direct-fed jet and through the at least one rim opening, a method for providing a toilet capable of operating at a flush volume of no greater than about 6.0 liters, and more preferably no greater than about 4.8 liters, the method comprising introducing fluid from a fluid source through a toilet bowl assembly inlet and into the direct-fed jet and into the rim channel so that fluid flows into an interior of the toilet bowl from the direct-fed jet under pressure and from the at least one rim opening in a sustained pressurized manner such that an integral of a curve representing rim pressure plotted against time during a flush cycle exceeds 3 in. $H_2O\cdot s$ in a flush cycle of about 6 liters, and preferably also exceeds 3 in. $H_2O\cdot s$ in a flush cycle of about 4.8 liters.

In preferred embodiments, the integral of a curve representing rim pressure plotted against time during a flush cycle exceeds 5 in. $H_2O\cdot s$. In preferred embodiments, the toilet is capable of operating at a flush volume of no greater than about 4.8 liters.

In the method, the toilet bowl assembly may further comprise a primary manifold in fluid communication with the toilet bowl assembly inlet, the primary manifold capable of receiving fluid from the toilet bowl assembly inlet, the primary manifold being in fluid communication with the rim channel and the direct-fed jet for directing fluid from the bowl inlet to the rim channel and the direct-fed jet, wherein the primary manifold has a cross-sectional area ($A_{pm}$); wherein the direct-fed jet has an inlet port having a cross-sectional area ($A_{jip}$) and an outlet port having a cross-sectional area ($A_{jop}$); and wherein the rim channel has an inlet port having a cross-sectional area ($A_{rip}$) and the at least one outlet port has a total cross-sectional area ($A_{rop}$), wherein the method further comprises configuring the bowl so that:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

In preferred embodiments of the method, the cross-sectional area of the primary manifold is greater than or equal to about 150% of the sum of the cross-sectional area of the direct-fed jet outlet port and the total cross-sectional area of the at least one rim outlet port, and more preferably the cross-sectional area of the rim inlet port is greater than or equal to about 250% of the total cross-sectional area of the at least one rim outlet port.

Also within the invention is a siphonic, gravity-powered toilet having a toilet bowl assembly, the toilet bowl assembly comprising a toilet bowl assembly inlet in fluid communication with a source of fluid, a toilet bowl having a rim around an upper perimeter thereof and defining a rim channel, the rim having an inlet port and at least one rim outlet port, wherein the rim channel inlet port is in fluid communication with the toilet bowl assembly inlet, a bowl outlet in fluid communication with a sewage outlet, and a direct-fed jet in fluid communication with the toilet bowl assembly inlet for receiving fluid from the source of fluid and the bowl outlet for discharging fluid, wherein the toilet is capable of operating at a flush volume of no greater than about 6.0 liters, and preferably no greater than about 4.8 liters, and the water exiting the at least one rim outlet port is pressurized, and wherein the toilet bowl assembly further comprises a primary manifold in fluid communication with the toilet bowl assembly inlet capable of receiving fluid from the toilet bowl assembly inlet, the primary manifold also in fluid communication with the rim channel and the direct-fed jet for directing fluid from the toilet bowl assembly inlet to the rim channel and the direct-fed jet, wherein the primary manifold has a cross-sectional area ($A_{pm}$); wherein the direct-fed jet has an inlet port having a cross-sectional area ($A_{jip}$) and an outlet port having a cross-sectional area ($A_{jop}$) and further comprises a jet channel extending between the direct-fed jet inlet port and the direct-fed jet outlet port; and wherein the rim channel has an inlet port having a cross-sectional area ($A_{rip}$) and the at least one outlet port has a total cross-sectional area ($A_{rop}$), wherein:

$$Apm>Ajip>Ajop \quad \text{(I)}$$

$$Apm>Arip>Arop \quad \text{(II)}$$

$$Apm>1.5\cdot(Ajop+Arop) \text{ and} \quad \text{(III)}$$

$$Arip>2.5\cdot Arop. \quad \text{(IV)}$$

In a preferred embodiment, the above-noted toilet is capable of providing flow from the at least one rim outlet port which is pressurized in a sustained manner for a period of time, preferably at least 1 second. The toilet may also be capable of providing the sustained pressurized flow from the at least one rim outlet port generally simultaneously with flow through the direct-fed jet. In further preferred embodiments, the integral of a curve representing rim pressure plotted against time during a flush cycle exceeds 3 in. $H_2O$·s for a flush cycle of about 6 liters, and preferably also for a flush cycle of about 4.8 liters.

In yet further preferred embodiments of the above-noted toilet, $A_{pm}$ is about 9 to about 15 square inches, more preferably about 10.78 square inches, $A_{jip}$ is about 5 to about 12 square inches, more preferably about 5.26 square inches, $A_{jop}$ is about 1 to about 3.5 square inches, more preferably about 1.10 square inches, $A_{rip}$ is about 3 to about 12 square inches, more preferably about 3.87 square inches, and $A_{rop}$ is about 0.45 to about 4 square inches, more preferably about 0.49 square inches. In addition, $A_{pm}/(A_{rop}+A_{jop})$ is about 500% to about 1200% and $A_{rip}/A_{rop}$ is about 700% to about 3000%.

Various other advantages, and features of the present invention will become readily apparent from the ensuing detailed description and the novel features will be particularly pointed out in the appended claims.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

Figure 23:
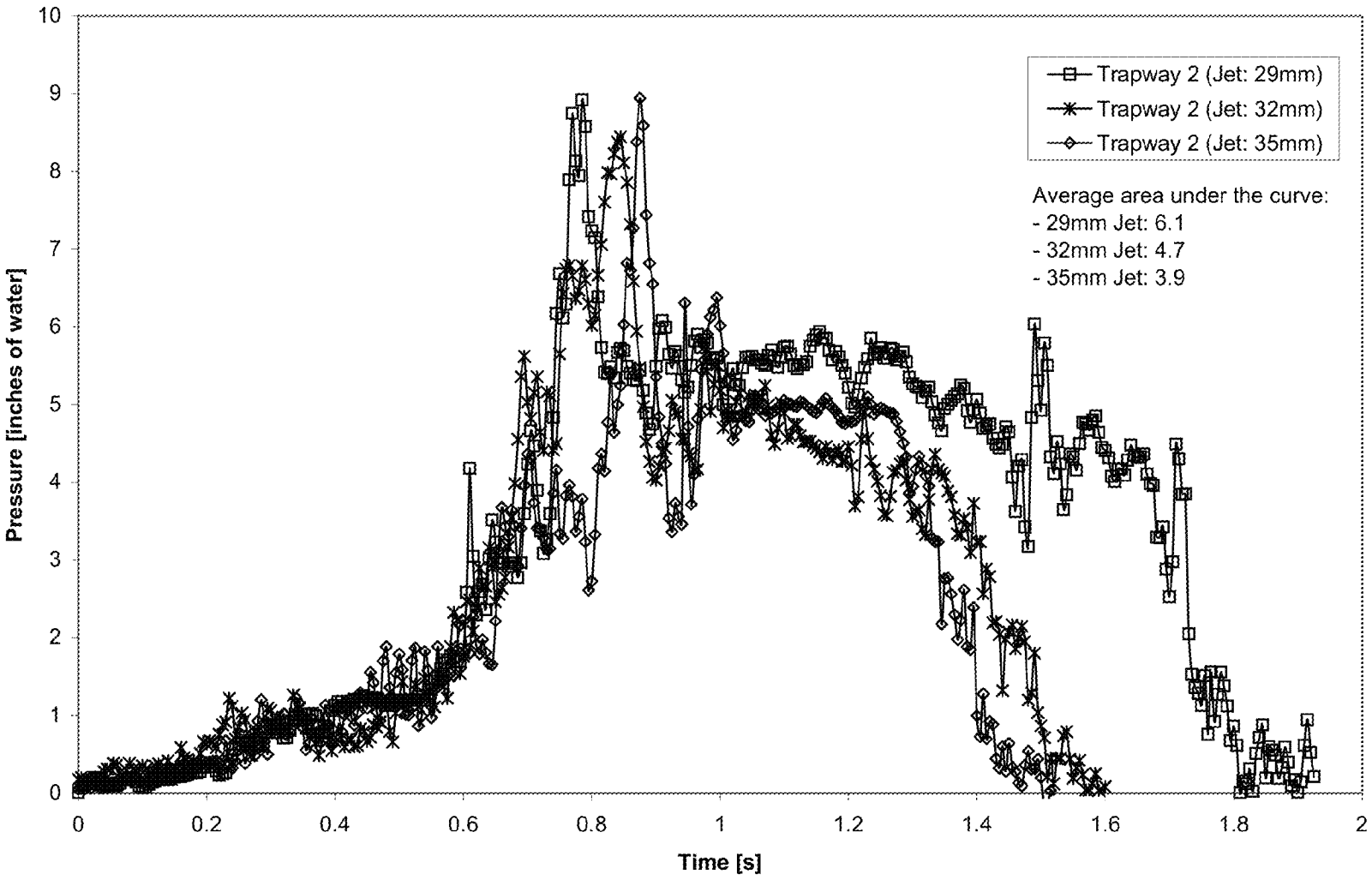
Figure 24:
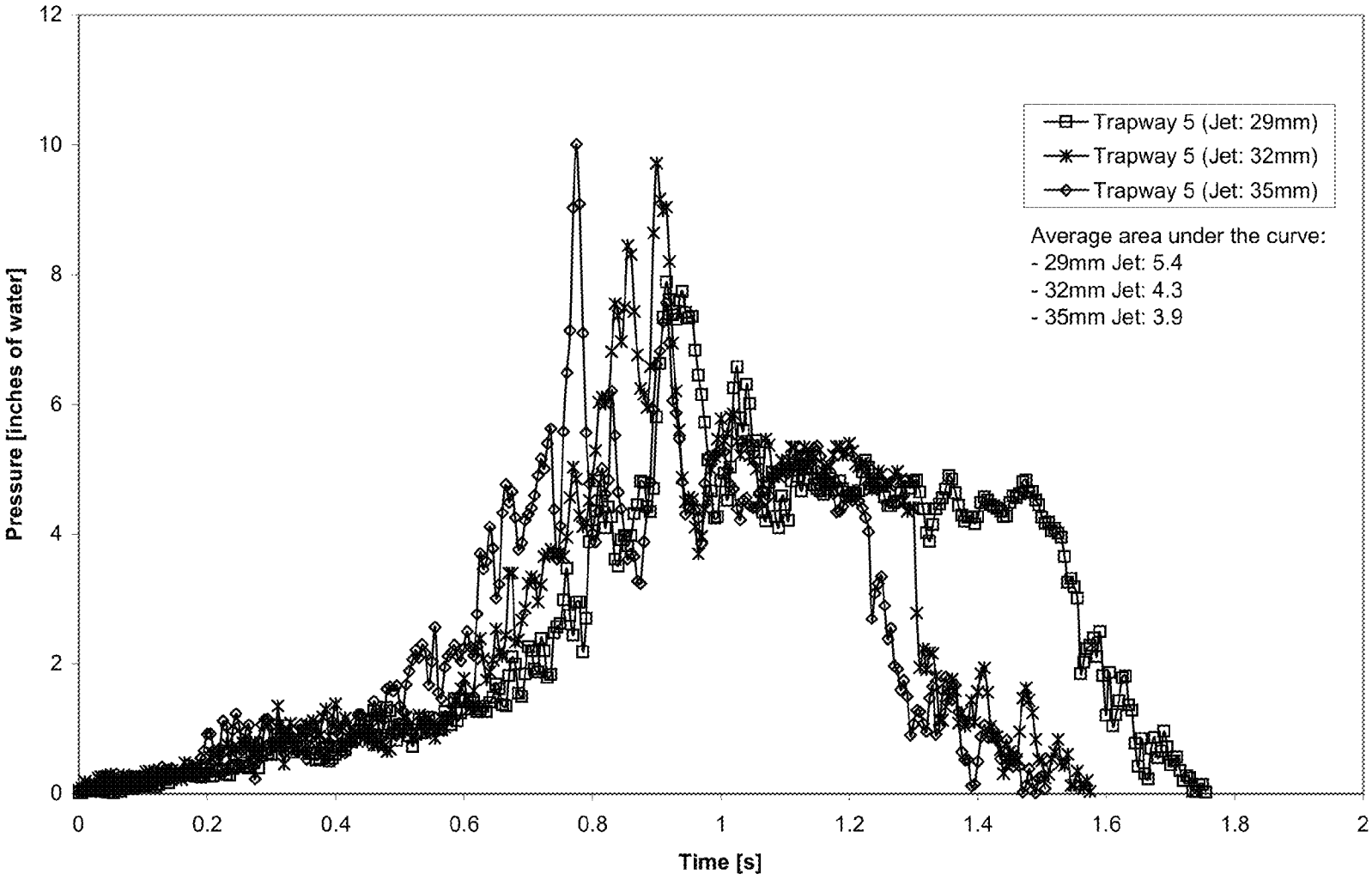

FIG. 23 is a graphical representation of pressure ((measured in inches of water (in. $H_2O$)) versus time (measured in seconds) for the toilet referenced in Examples 22-24 (each based on a series of averaged flushes at the conditions referenced in Table 4), and using a flush volume of 4.8 liters/flush (1.28 gallons/flush); and FIG. 24 is a graphical representation of pressure ((measured in inches of water (in. $H_2O$)) versus time (measured in seconds) for the toilet referenced in Examples 31-33 (each based on a series of averaged flushes at the conditions referenced in Table 4), and using a flush volume of 4.8 liters/flush (1.28 gallons/flush).

DETAILED DESCRIPTION OF THE INVENTION

The toilet system described herein provides the advantageous features of a rim-jetted system as well as those of a direct-jetted system. The inner water channels of the toilet system are designed such that the water exiting the rim of the direct-jetted system is pressurized. The toilet is able to maintain resistance to clogging consistent with today's 6.0 liters/flush (1.6 gallons/flush toilets), and preferably with toilets utilizing 4.8 liters/flush (1.28 gallons/flush), while still delivering superior bowl cleanliness at reduced water usages.

Figure 1:
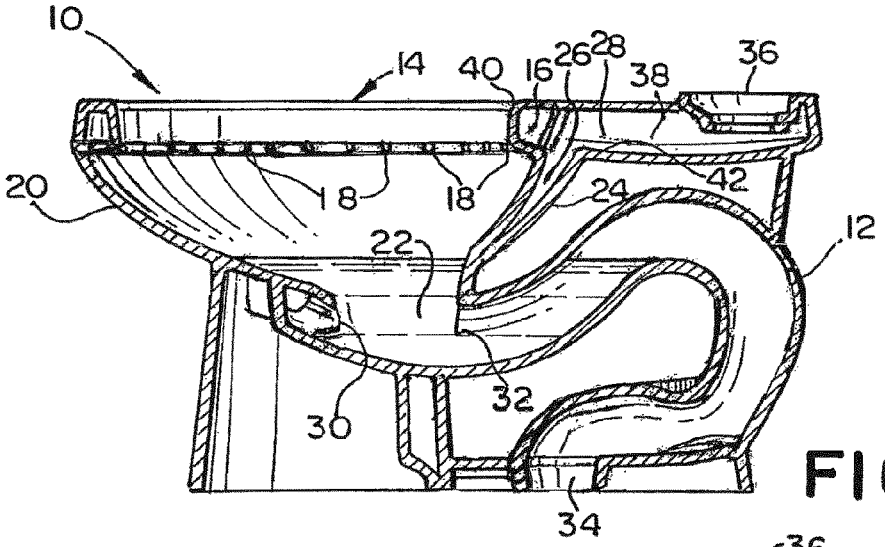
FIG. 1 is a longitudinal, cross-sectional view of a toilet bowl assembly for a toilet according to an embodiment of the invention.

Referring now to FIG. 1, an embodiment of a toilet bowl assembly for a gravity-powered, siphonic toilet is shown.

The toilet bowl assembly, referred to generally as 10 therein is shown without a tank. It should be understood however, that any toilet having a toilet bowl assembly 10 as shown and described herein would be within the scope of the invention, and that the toilet bowl assembly 10 may be attached to a toilet tank (not shown) or a wall-mounted flush system engaged with a plumbing system (not shown) to form a toilet according to the invention. Thus, any toilet having the toilet bowl assembly herein is within the scope of the invention, and the nature and mechanisms for introducing fluid into the toilet bowl assembly inlet for flushing the toilet, whether a tank or other source, is not important, as any such tank or water source may be used with the toilet bowl assembly in the toilet of the present invention. As will be explained in greater detail below, preferred embodiments of toilets having a toilet bowl assembly according to the invention are capable of delivering exceptional bulk waste removal and bowl cleansing at flush water volumes no greater than about 6.0 liters (1.6 gallons) per flush and more preferably 4.8 liters per flush (1.28 gallons) and more preferably 3.8 liters (1.0 gallons) per flush. It should be understood by those skilled in the art based on this disclosure that by being capable of achieving these criteria at flush volumes of about 6.0 liters or less, that does not mean that the toilet would not function well at higher flush volumes and generally would indeed achieve good flush capabilities at higher flush volumes, however, such capability means that the toilet which can operate at a wide range of flush volumes can still achieve advantageous waste removal and bowl cleansing even at lower flush volumes of 6.0 liters, 4.8 liters or below to meet tough water conservation requirements.

As shown in FIG. 1, the toilet bowl assembly 10 includes a trapway 12, a rim 14 configured so as to define a rim channel 16 therein. The rim channel has at least one outlet port 18 therein for introducing fluid, such as flush water, into a bowl 20 from within the rim channel 16. The assembly includes a bottom sump portion 22. A direct-fed jet 24 (as shown best in FIGS. 3 and 4) includes a jet channel or passageway 26 extending between a direct-fed jet inlet port 28 to a direct-fed jet outlet port 30. As shown, there are two such channels 26 running so as to curve outward around the bowl 20 within the overall structure. The channels feed into a single direct-fed jet outlet port 30, however, it should be understood based on this disclosure that more than one such direct-fed jet outlet may be provided, each at the end of a channel 26 or at the end of multiple such channels. However, it is preferred to concentrate the jet flow from the dual channels as shown into a single direct-fed jet outlet 30. The toilet assembly has an outlet 32 which is also the general entrance to the trapway 12. The trapway 12 is curved as shown to provide a siphon upon flushing and empties into a sewage outlet 34.

The toilet bowl assembly 10 further has a toilet bowl assembly inlet 36 which is in communication with a source of fluid (not shown), such as flush water from a tank (not shown), wall-mounted flusher, etc. each providing fluid such as water from a city or other fluid supply source, including various flush valves as known in the art. If a tank were present, it would be coupled above the back portion of the toilet bowl assembly over the toilet bowl assembly inlet 36. Alternatively, a tank could be integral to the body of the toilet bowl assembly 10 provided it were located above the toilet bowl assembly inlet 36. Such a tank would contain water used for initiating siphoning from the bowl to the sewage line, as well as a valve mechanism for refilling the bowl with fresh water after the flush cycle. Any such valve or flush mechanism is suitable for use with the present invention. The invention also is able to be used with various dual- or multi-flush mechanisms. It should be understood therefore by one skilled in the art based on this disclosure that any tank, flush mechanism, etc. in communication with a water source capable of actuating a flushing siphon and introducing water into the inlet 36, including those mechanisms providing dual- and multi-flush which are known in the art or to be developed at a future date may be used with the toilet bowl assembly herein provided that such mechanism(s) can provide fluid to the bowl assembly and are in fluid communication with the inlet port of the rim channel and the inlet port of the direct-fed jet.

The inlet 36 allows for fluid communication from the inlet of fluid to the direct-fed jet 24 and the rim channel 16. Preferably, fluid flows from the inlet 36 first through a primary manifold 38 from which the flow separates into a first flow entering the direct-fed jet inlet port 28 and a second flow entering into an inlet port 40 into the rim channel 16. From the direct-fed jet inlet port 28, fluid flows into the jet channel 26 and ultimately through the direct-fed jet outlet port 30. From the inlet port 40 of the rim channel, fluid flows through the rim channel in preferably both directions (or the toilet bowl assembly could also be formed so as to flow in only one direction) and out through at least one, and preferably a plurality of rim outlet ports 18. While the rim outlet ports may be configured in various cross-sectional shapes (round, square, elliptical, triangular, slit-like, etc.), it is preferred for convenience of manufacturing that such ports are preferably generally round, and more preferably generally circular in cross-sectional configuration.

In a toilet according to the invention including a toilet bowl assembly 10 as described herein, flush water passes from, for example, a water tank (not shown) into the toilet bowl 20 through the toilet bowl assembly inlet 36 and, and preferably into a primary manifold 38. At the end 42 of the primary manifold furthest from the inlet 36, the water is divided. A first flow of the water, as noted above, flows through the inlet port 28 of the direct-fed jet 24 and into the jet channel 26. The second or remaining flow, as noted above, flows through the rim inlet port 40 into the rim channel 16. The water in the direct-fed jet channel 26 flows to the jet outlet port 30 in the sump 22 and directs a strong, pressurized stream of water at the outlet of the bowl which is also the trapway opening 32. This strong pressurized stream of water is capable of rapidly initiating a siphon in the trapway 12 to evacuate the bowl and its contents to the sewer line in communication with sewage outlet 34. The water that flows through the rim channel 16 causes a strong, pressurized stream of water to exit the various rim outlet ports 18 which serves to cleanse the bowl during the flush cycle.

Figure 2:
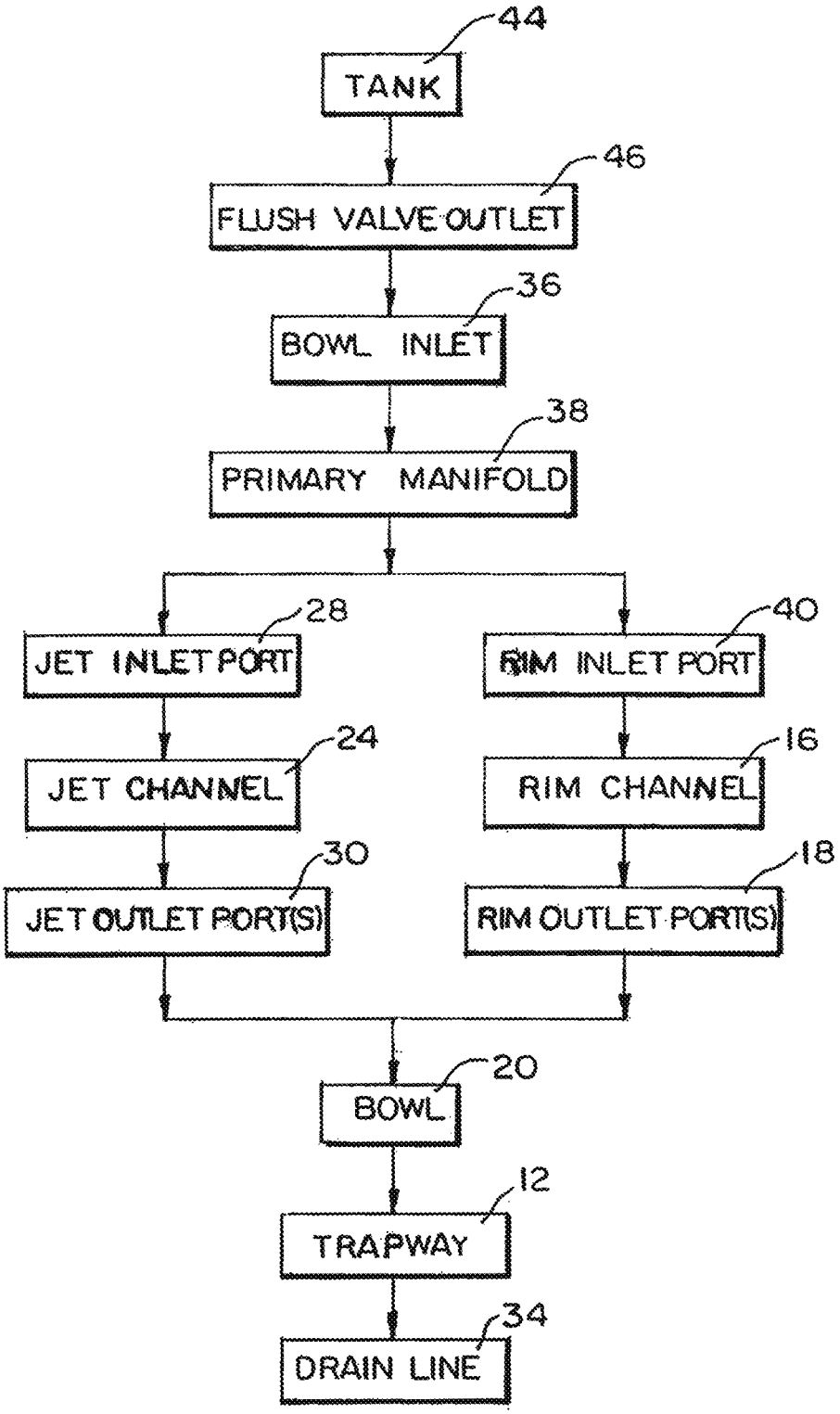
FIG. 2 is a flow diagram showing the flow of fluid through various aspects of a toilet bowl assembly for a toilet according to an embodiment of the invention.

In FIG. 2, the preferred primary features of the hydraulic pathway of a direct-fed jet toilet herein are explained in a flow chart. Water flows from a tank 44 through an outlet of the flush valve 46 and the bowl inlet 36 and into the primary manifold 38 of the toilet bowl assembly 10. The primary manifold 38 then separates the water into two or more streams: one passes through the direct-fed jet inlet port 28 into the jet channel 24 and the other passes through the rim inlet port 40 into the rim channel 16. The water from the rim channel passes through the rim outlet ports 18 and enters the bowl 20 of the toilet. Water from the jet channel 26 passes through the direct-fed jet outlet port(s) 30 and converges again with water from the rim channel 16 in the bowl 20 of the toilet. The reunified stream exits the bowl through the trapway 12 on its way to the sewage outlet 34 and drain line.

Figure 3:
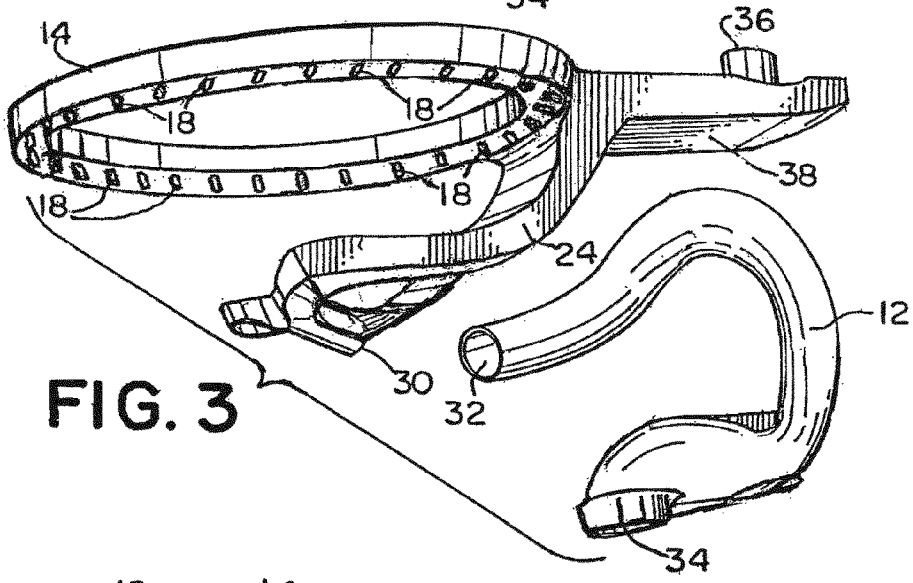
FIG. 3 is an perspective view of the internal water chambers of the toilet bowl assembly of FIG. 1.
Figure 4:
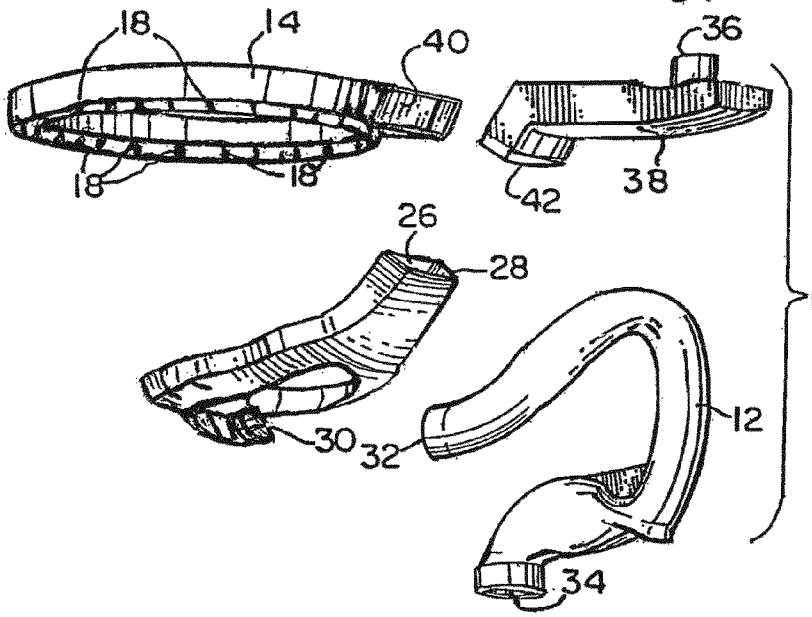
FIG. 4 is a further exploded perspective view of the internal water chambers of the toilet bowl assembly of FIGS. 1 and 3.

FIG. 3 shows a perspective view of the internal water channels of a direct-fed jet toilet according to the present invention. The primary manifold 38, jet channel 24, and rim 14 defining the channel are shown as one design with the trapway 12, wherein the parts are shown in a partially disconnected view wherein the parts are disconnected by a distance that would be the length of the sump 22. In FIG. 4, the primary manifold 38, jet channel 24, and rim 14, are separated and shown in exploded perspective view to better show the rim inlet port 40 and the direct-fed jet inlet port 28. In the embodiment of the invention as shown in FIGS. 1, 3 and 4, the primary manifold, jet channel, and rim channel are formed as a continuous chamber. In other embodiments, they may be formed as separate chambers and holes are opened during the manufacturing process to create the rim inlet port and jet inlet port.

Figure 20:
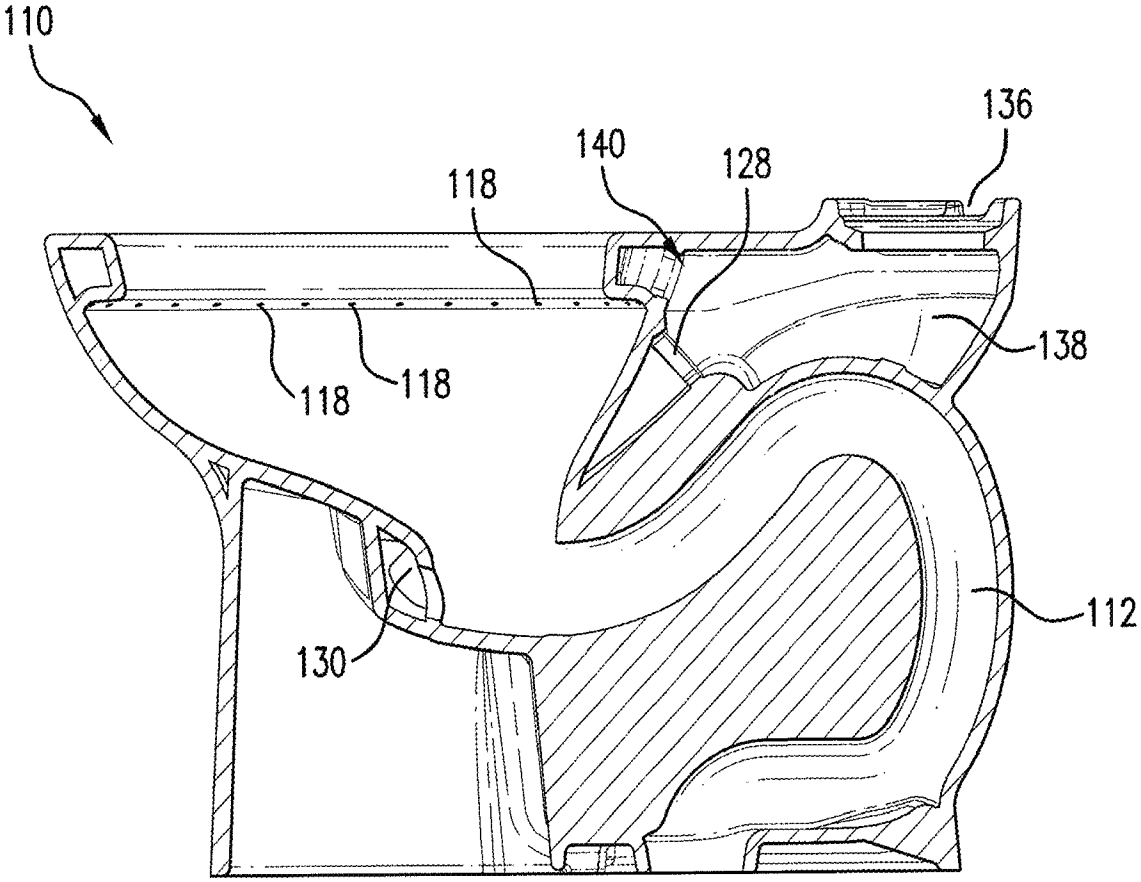
FIG. 20 is a longitudinal, cross-sectional view of a toilet bowl assembly for a toilet according to a further larger pathway embodiment of the invention.

FIG. 20 shows a further embodiment herein, identified as toilet assembly 110. All reference numbers shown identify analogous portions of the embodiment of toilet assembly 10 shown in FIG. 1. As FIG. 20 illustrates, the primary manifold 138 represents a large opening for feeding the jet and rim to accommodate a larger flush valve and greater flush volume passing through the valve opening as well as illustrates a larger trapway 112 for toilet assemblies having a greater overall size. Thus, while the embodiment shown herein can be configured in a variety of sizes, a smaller overall design would generally use a smaller opening and primary manifold for introducing fluid, for example, a 2-inch flush valve, while a larger overall design, may use a 3-inch flush valve. Thus, size can vary as noted herein.

Figure 21:
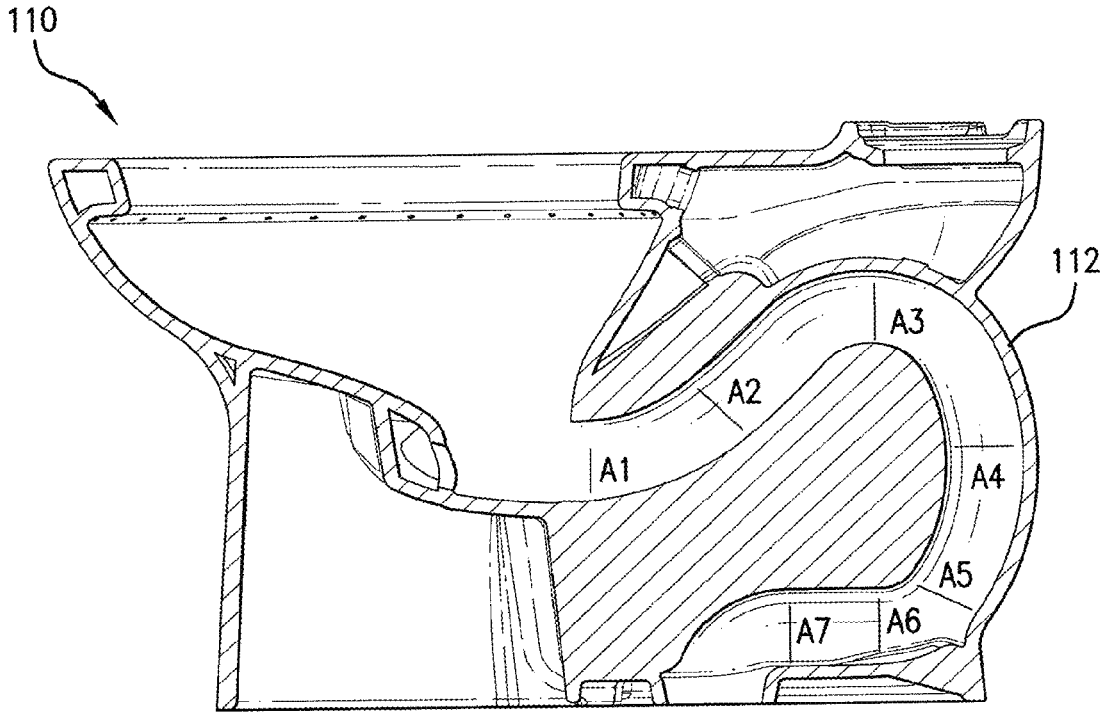
FIG. 21 is an outline of a trapway of the embodiment of FIG. 20 identifying various sections for evaluating the overall geometry of the trapway.
Figure 22:
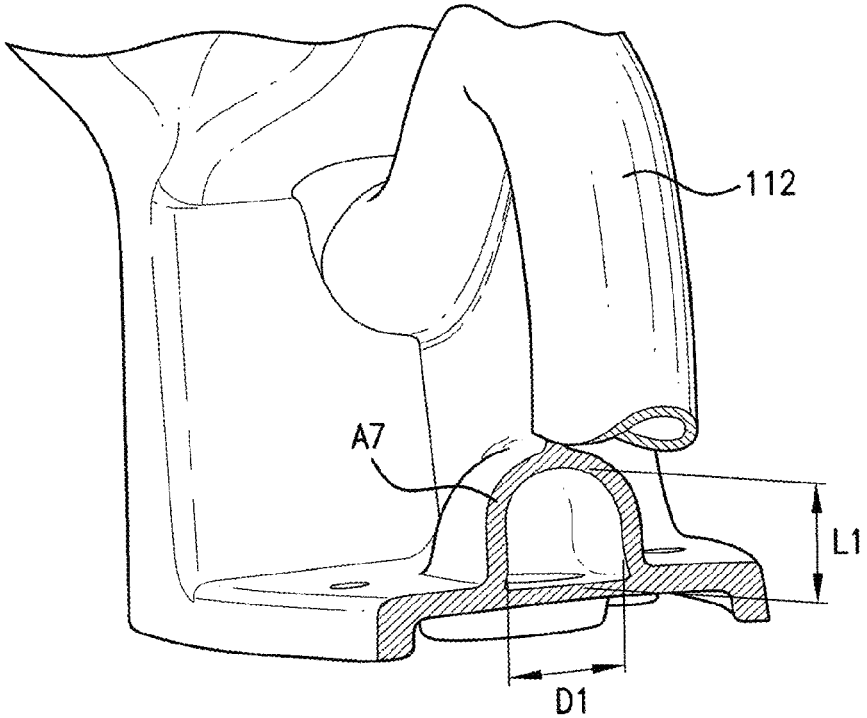
FIG. 22 is a cross-sectional view showing the longitudinal and transverse measurements used for evaluating the geometry of the trapway of FIG. 21 along an area at the section identified as A7 herein.

As shown in FIG. 21, various standard trapways may also be used with the embodiments of FIG. 1 or FIG. 20. While most standard trapways are estimated as reasonably constant along their path, the diameter or width of a trapway at any particular cross-section along the trapway path can vary as it turns and the trapway shapes are designed to accommodate siphoning action as noted in the Background section herein, and in the case of the present invention also working with the jet and pressurized rim. An example of a typical variation in a trapway which is sized so as to be a more generally large embodiment as in FIG. 20 is shown in FIG. 21. The trapway 112 shown in FIG. 21 has measurements that vary along the path as illustrated by the variation in shape and size along the Area sections shown in FIG. 21 identified as Areas A1, A2, A3, A4, A5, A6 and A7. Due to the change in shape as the trapway connects towards a sewer drain, approximations of area in this section, e.g., as per section A7 are calculated using the generally transverse dimension D1 and the generally longitudinal dimension L1 as shown in FIG. 22.

It should also be understood that the actual geometry and size used in the toilet bowl assembly of the present invention can be varied, but preferably still maintains the basic flow path outlined in FIG. 2. For example, the direct-jet inlet port can lead into one, single jet channel running asymmetrically around one side of the bowl. Or it could lead into two, dual jet channels which run symmetrically or asymmetrically around both sides of the bowl. The actual pathway that the jet channel, rim channel, primary manifold, etc., travels can vary in three dimensions. All possible permutations of various direct-fed jet toilets may be used within the scope of this invention.

However, the inventors have discovered that by controlling the cross-sectional areas and/or volumes of the specified chambers and passageways, a toilet having a toilet bowl assembly according to the invention may be provided having exceptional hydraulic performance at low flush volumes, incorporating the bowl cleaning ability of various prior art rim-fed jet designs while also providing the bulk removal capability of various direct-fed jet designs.

Pressurization of the rim in a direct-jet toilet provides the aforementioned advantages for bowl cleaning, but the inventors have discovered that it also enables high performance to be extended to extremely low flush volumes without requiring major sacrifice in the cross-sectional area of the trapway. The inventors have found that pressurizing the rim has a dual impact on the hydraulic performance. Firstly, the pressurized water exiting the rim holes has greater velocity which, in turn, imparts greater shear forces on waste matter adhered to the toilet bowl. Thus, less water can be partitioned to the rim and more can be partitioned to the jet. Secondly, when the rim pressurizes, it exerts an increased back pressure over the rim inlet port, which in turn, increases the power and duration of the jet water. These two factors in combination provide for a longer and stronger jet flow, allowing the toilet designer the option of using a trapway with larger volume without loss of siphoning capability. Thus, pressurizing the rim not only provides for a more powerful rim wash, but it also provides for a more powerful jet, enables lower water consumption by reducing the water required to wash the rim, and enables a larger trapway to be used at low flush volumes without loss of siphon.

The ability to achieve the aforementioned advantages and provide exceptional toilet perfoiniance at flush volumes no greater than about 6.0 liters per flush (1.6 gallons per flush), and preferably no greater than about 4.8 liters per flush (1.28 gallons per flush) relies on generally simultaneously pressurizing the rim channel 16 and direct jet channel 24 such that powerful streams of pressurized water generally simultaneously flow from the jet outlet port 30 and rim outlet ports 18. As used herein, "generally simultaneous" flow and pressurization means that each of the pressurized flow through the rim and the direct jet channel flow occur for at least a portion of the time that they occur at the same time, however, the specific initiating and terminating time for flow to the rim and jet channel may vary somewhat. That is, flow through the jet may travel directly down the jet channel and out the jet outlet port and enter the sump area at a time different from the entry of water passing through the rim channel outlets in pressurized flow and one of these flows may stop before the other, but through at least a portion of the flush cycle, the flows occur simultaneously.

Pressurization of the rim channel 16 and direct jet channel 24 is preferably achieved by maintaining the relative cross-sectional areas as in relationships (I)-(IV):

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop} \quad \text{(IV)}$$

wherein $A_{pm}$ is the cross-sectional area of the primary manifold, such as primary manifold 38, $A_{jip}$ is the cross-sectional area of the jet inlet port such as direct-fed jet inlet port 28, $A_{rip}$ is the cross-sectional area of the rim inlet port such as rim inlet port 40, $A_{jop}$ is the cross-sectional area of the jet outlet port such as direct-fed jet outlet port 30, and $A_{rop}$ is the total cross-sectional area of the rim outlet ports such as rim outlet ports 18. Maintaining the geometry of the water channels within these parameters allows for a toilet that maximizes the potential energy available through the gravity head of the water in the tank, which becomes extremely critical when reduced water volumes are used for the flush cycle. In addition, maintaining the geometry of the water channels within these parameters enables pressurization of the rim and jet channels generally simultaneously in a direct fed jet toilet, maximizing the performance in both bulk removal and bowl cleaning. As measured herein for the purpose of evaluating these relationships, all area parameters are intended to mean the sum of the inlet/outlet areas. For example, since there are preferably a plurality of rim outlet ports, the area of the rim outlet ports is the sum of all of the individual areas of each outlet port. Similarly, if multiple jet flow channels or outlet/inlet ports are used, then the jet inlet area or jet outlet area would be the sum of the areas of all jet inlet ports and of all jet outlet ports respectively.

With respect to relationships (III) and (IV), while such relationships provide general minimum values with respect to the ratios of the area of the primary manifold to the sum of the areas of the rim outlet port(s) and the direct-fed jet outlet port(s) and the ratio of the area of the rim inlet port to the rim outlet port, it should be understood that such ratios can reach a maximum where benefits such as those described herein may not be readily achievable. Also there are values for such ratios where performance is most likely to be most beneficial. As a result it is preferred that with respect to relationship (III), the ratio of the area of the primary manifold to the sum of the areas of the rim outlet port(s) and the direct-fed jet outlet port(s) be about 150% to about 2300%, and more preferably about 150% to about 1200%. It is also preferred that with respect to relationship (IV), the ratio of the area of the rim inlet port to the rim outlet port is about 250% to about 5000% and more preferably about 250% to about 3000%.

Representative examples of areas which can meet such parameters are shown below in Table 1.

TABLE 1

| Parameter | Min. Area (sq. in.) | Max. Area (sq. in.) | Preferred Min. Area (sq. in.) | Preferred Max. Area (sq. in. |
|---|---|---|---|---|
| $A_{pm}$ | 3 | 20 | 3.5 | 15 |
| $A_{jip}$ | 2.5 | 15 | 4 | 12 |
| $A_{jop}$ | 0.6 | 5 | 0.85 | 3.5 |
| $A_{rip}$ | 1.5 | 15 | 2 | 12 |
| $A_{rop}$ | 0.3 | 5 | 0.4 | 4 |
| $A_{pm}/(A_{rop} + A_{jop})$ | 150% | 2300% | 150% | 1200% |
| $A_{rip}/A_{rop}$ | 250% | 5000% | 250% | 3000% |

The cross-sectional area of the jet channel(s), $A_{jc}$ and the cross-sectional area of the rim channel(s), $A_{rc}$, is also of importance but are not as important as the factors noted in the relationships (I)-(IV) above. In general, the jet channels should be sized such that the range of cross-sectional areas is between $A_{jip}$ and $A_{jop}$. However, in practice, the jet channels are always at least partially filled with water, which makes the upper boundary on the cross sectional area of the jet channel somewhat less critical. There is, however, clearly a point where the jet channel becomes too constrictive or too expansive. The cross sectional area of the rim channel is also less important, because the rim is not intended to be completely filled during the flush cycle. Computational Fluid Dynamics (CFD) simulations clearly show that water rides along the lower wall of the rim channel, and when all of the rim outlet ports become filled, pressure begins to build in the air above the layer of water. Increasing the size of the rim would thus reduce the rim pressure proportionally. But the effect would likely be minor within the expected range of aesthetically acceptable toilet rims. There is also, of course, a lower limit where the cross sectional area of the rim becomes too constrictive. At minimum, the cross sectional area of the rim channel should exceed the total area of the rim outlet ports.

In various embodiment herein, in accordance with the parameters noted above, toilets may be configured having different designs and pathways. Toilets may be configured having larger flush valve openings, manifolds and trapways and tending towards a larger overall hydraulic pathway such as that shown in FIG. 20, as well as in various sizes as shown in the embodiment shown in FIG. 1, yet fall within the preferred relationships and preferred parameter ranges noted above, and provide the benefits of the invention so as to be useful to improve the performance of a variety of sizes, including more traditional, larger hydraulic pathway toilets. Of particular benefit is that such variations in design within the scope of the invention provide high levels of flush performance at low flush volumes such as no greater than about 6.0 liters per flush or more preferably no greater than about 4.8 liters per flush. Such designs are capable of achieving fast and strong flushing, while incorporating the benefits of a pressurized rim and conserving water.

Preferred parameters for a larger scale embodiment along with a preferred example of a larger diameter manifold and trapway configuration are shown in Table 2 and are shown in FIGS. 20-22. In FIG. 20, an example embodiment shows general cross sectional areas as follows: inlet 136 to the bowl (4567 $mm^2$), manifold 138 (6952 $mm^2$), direct-fed jet inlet port 128 (3394 $mm^2$), direct-fed jet outlet port 130 (710 $mm^2$), rim channel inlet port 140 (2498 $mm^2$), rim channel outlets 118 (316 $mm^2$).

TABLE 2

| Parameter | Min. Area (sq. in.) | Max Area (sq. in.) | Preferred Example Area (sq. in.) |
|---|---|---|---|
| $A_{pm}$ | 9 | 15 | 10.78 |
| $A_{jip}$ | 5 | 12 | 5.26 |
| $A_{jop}$ | 1 | 3.5 | 1.10 |
| $A_{rip}$ | 3 | 12 | 3.87 |
| $A_{rop}$ | 0.45 | 4 | 0.49 |
| $A_{pm}/(A_{rop} + A_{jop})$ | 500% | 1200% | 678% |
| $A_{rip}/A_{rop}$ | 700% | 3000% | 790% |

Such a design incorporates a generally large opening into the assembly from a tank (for example a three-inch flush valve opening), a generally large manifold and a generally large trapway diameter along with the jet and pressurized rim of the present invention to provide a strong flush, with excellent rim pressure for cleaning at low flush volumes, for example, at about 6.0 liters per flush, and preferably at about 4.8 liters per flush. Such a flush in a larger geometry may typically provide a relatively faster flush than achievable according to the invention using an overall smaller geometry pathway, including use of smaller trapways, smaller openings to the assembly and smaller manifolds, however, the high performance achieved is an improvement over comparable geometry toilets which are simply direct fed and lack any pressurization of the rim. This illustrates that a variety of hydraulic pathways may be designed within the relationships and parameters noted above, while achieving excellent peak flow rates, time and other parameters as noted elsewhere herein at low flush volumes.

In addition to the four relationships above, certain other geometrical details are relevant to achieving even more preferred results within the scope of the invention. For example, as noted above, and with reference to FIGS. 20 and 21, the general measurements along the trapway can also vary and can contribute to the power or speed of the flush, even though generally providing a design having the parameters noted above in the ratios and ranges provided yields an improved flush over a design lacking in such parameters and lacking a pressurized rim in combination with a direct fed jet. FIG. 20 shows an FIG. 21 illustrates a trapway 112 having sections A1-A7. The measurements are of a generally larger trapway size, and are based on a round diameter of 2.44 in. (62 mm) at A1; a round diameter of 2.40 in. (61 mm) at A2; a round diameter of 2.17 in. (55 mm) at A3; a round diameter of 2.13 in. (54 mm) at A4 and at A5; and 2.17 in. (parameter D1)×2.28 in. (parameter L1)(55 mm×58 mm) at each of A6 and A7, wherein FIG. 22 illustrates dimensions D1 and L1 using section A7, with an example being shown having, e.g., a D1 of 55 mm and an L1 of 58 mm.

Such dimensions are examples only but illustrate that the trapway is not constant and can be configured in various overall sizes, but as known in the art, its geometry can impact overall performance in most toilet assembly designs. Such variations provided they are not overly constrictive should still function well within the present invention in providing a design having improved flow and high performance characteristics at lower flush volume over a toilet lacking the preferred inventive parameters and relationships and/or lacking the combination of a pressurized rim and direct fed jet.

In general, all of the water channels and ports should be preferably designed to avoid unnecessary constriction in flow. Constriction can be present as a result of excessive narrowing of a passageway or port or through excessive bends, angles, or other changes in direction of flow path. For example, a jet channel could have a cross-sectional area within the desired range, but if it turns sharply, energy will be lost due to turbulence generated by the changes in direction. Or, the average cross-sectional area of the jet might be within the desired range, but if it varies in cross-sectional area such that constrictions or large openings are present, it will detract from the performance. In addition, channels should be designed to minimize the volume required to fill them without unduly constricting the flow of water. Furthermore, the angles at which the ports encounter the flowing water can have an impact on their effective cross sectional area. For example, if the rim inlet port is placed in a position parallel to the flow path of the water, less water will enter the port than if a port of equal cross sectional area is placed perpendicular to the direction of flow. Likewise, the predominant flow of water through the hydraulic channels of the toilet is downward. Ports that are positioned in a downward direction to the flowing water will have a larger effective area than those that are placed in an upward direction.

In practice, high performance, low water usage toilets under the present invention can be readily manufactured by standard manufacturing techniques well known to those skilled in the art. The geometry and cross sectional areas of the primary manifold, jet inlet port, rim inlet port, rim channels, jet channels, jet outlet ports, and rim outlet ports can be controlled by the geometry of the molds used for slip casting or accurately cut by hand using a gage or template.

The invention will now be explained by way of the following non-limiting examples and comparative examples.

EXAMPLES

Examples are provided herein to demonstrate the utility of the invention but are not intended to limit the scope of the invention. Data from the examples are summarized in Tables 3 and 4. In all of the subsequent examples, several geometrical aspects of comparative and inventive toilets will be presented and discussed. The geometrical factors are defined and measured as follows:

"Area of flush valve outlet": This is calculated by measuring the inner diameter of the bottom-most portion of the flush valve through which the water exits and enters the primary manifold.

"Cross-sectional area of the primary manifold": This is measured as the cross-sectional area of the primary manifold of the toilet at a distance 2 inches (5.08 cm) downstream from the edge of the bowl inlet. Toilets were sectioned in that area and the cross-sectional geometry was measured by comparison to a grid of 0.10 inch (0.254 cm) squares.

"Jet inlet port area": This is defined as the cross-sectional area of the channel immediately before water enters the jet channel(s). In some toilet designs, this port is well defined as a manually cut or punched opening between the jet pathway and rim pathway. In other designs, such as that shown in FIGS. 1 and 3, the pathway is more fluid and the transition from primary manifold to jet channel is less abrupt. In this case, the jet inlet port is considered to be the logical transition point between the primary manifold and jet channels, as illustrated in FIG. 4.

"Rim inlet port area": This is defined as the cross-sectional area of the flow path at the transition point between the primary manifold and the rim channel(s). In some toilet designs, this port is well defined as a manually cut or punched opening between the jet pathway and rim pathway. In other designs, such as that shown in FIGS. 1 and 3, the pathway is more fluid and the transition from primary manifold to rim channel is less abrupt. In this case, the rim inlet port is considered to be the logical transition point between the primary manifold and rim channels, as illustrated in FIG. 4.

"Jet outlet port area": This is measured by making a clay impression of the jet opening and comparing it to a grid with 0.10 inch (0.254 cm) sections.

"Rim outlet port area": This is calculated by measuring the diameter of the rim holes and multiplying by the number of holes for each given diameter.

"Sump volume": This is the maximum amount of water that can be poured into the bowl of the toilet before spilling over the weir. It includes the volume in the bowl itself, as well as the volume of the jet channels and trapway below the equilibrium water level determined by the weir.

"Trap diameter": This is measured by passing spheres with diameter increments of 1/16 of an inch through the trapway. The largest ball that will pass the entire length of the trapway defines the trapway diameter.

"Trap volume": This is the volume of the entire length of the trapway from inlet in the sump to outlet at the sewage drain. It is measured by plugging the outlet of the trapway and filling the entire length of the trapway with water until it backs up to the trapway inlet. It is necessary to change the position of the bowl during filling to ensure that water passes through and fills the entire chamber.

"Peak flow rate": This is measured by initiating a flush cycle of the complete toilet system and collecting the water discharged from the outlet of the toilet directly into a vessel placed on a digital balance. The balance is coupled to a computer with data collection system, and mass in the vessel is recorded every 0.05 seconds. The peak flow rate is determined as the maximum of the derivative of mass with respect to time (dm/dt).

"Peak flow time": This is calculated along with the peak flow rate measurement as the time between initiation of the flush cycle and occurrence of the peak flow rate.

"Rim pressure": This is measured by drilling a hole in the top of the toilet rim at the 9 o'clock position, considering the location of the rim inlet port as 12:00. An airtight connection was made between this hole and a Pace Scientific® P300-10" D pressure transducer. The transducer was coupled to a data collection system and pressure readings were recorded at 0.005 second intervals during the flush cycle. These data were then smoothed by averaging eight sequential readings, resulting in 0.040 second intervals. CFD simulations were also utilized to calculate rim pressure throughout the flush cycle for various experimental toilet geometries. The interval time of pressure calculations for the CFD simulations was also 0.040 seconds.

"Bowl Scour": This is measured by applying an even coating of a paste made from 2 parts miso paste mixed with one part water to the interior of the bowl. The material is allowed to dry for a period of three minutes before flushing the toilet to assess its bowl cleaning capability. A semi-quantitative "Bowl Scour Score" is given using the following scale:

5—All of the test media is completely scoured away from the bowl surface in one flush.

4—Less than 1 square inch of total area is left unwashed on bowl surface after one flush and is totally removed by a second flush.

3—Greater than 1 square inch of total area is left unwashed on the bowl surface after one flush and is totally removed by a second flush.

2—Less than ½ square inch of total area is left unwashed on bowl surface after two flushes.

1—Greater than ½ square inch area is left unwashed on the bowl surface after two flushes.

0—Greater than ½ square inch area is left unwashed on the bowl surface after three flushes.

"Tank Head" indicates the height of the water in the tank measured from the bottom of the tank to the waterline.

Example 1 (Comparative)

Figure 11:
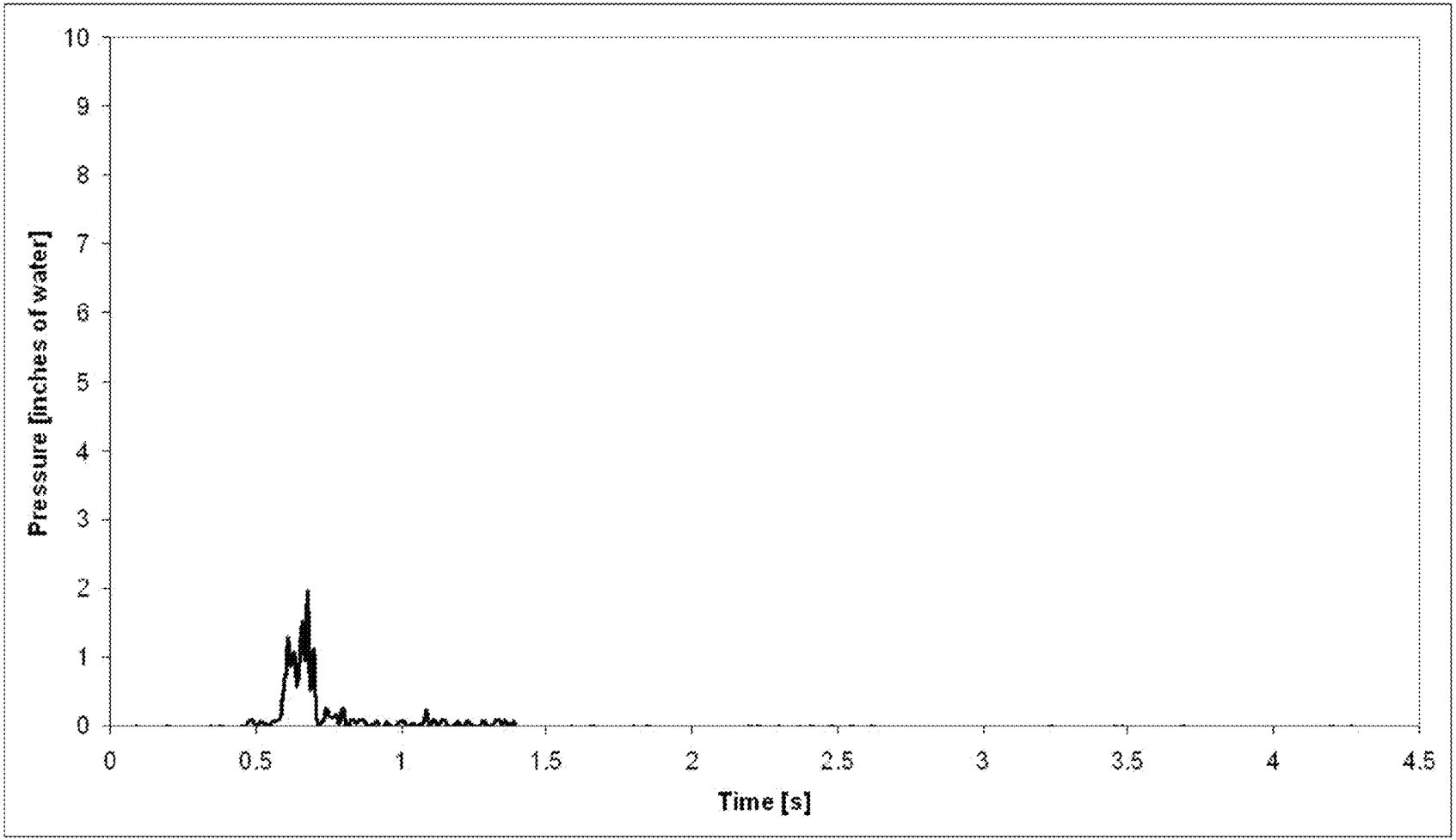
FIG. 11 is a graphical representation of the relationship of pressure ((measured in inches of water (in. $H_2O$)) versus time (measured in seconds) for Comparative Example 1.

A commercially available, 1.6 gallon per flush toilet with symmetrical, dual direct-fed jets was subjected to geometrical and performance analyses. The toilet is representative of many direct-fed jet toilets commercially available, in that the performance with respect to bulk removal is very good, scoring over 1,000 g on the MaP test (Veritec® Consulting Inc., MaP 13th Edition November '08, Mississauga, ON, Canada), but the minimal water directed to the rim for bowl cleansing is not pressurized. FIG. 11 shows a plot of the pressure recorded in the rim during the flush cycle. No sustained pressure was observed, only small spikes due to dynamic fluctuations. The integral of pressure-time curve was 0.19 in $H_2O$●s, indicating a nearly complete lack of pressurization.

In Table 3, the reason for the lack of rim pressurization is evident. The toilet fails to meet the criteria specified in this invention, most notably in that the rim outlet port area is actually greater than the rim inlet port area, instead of being twice as large or greater as taught herein. The cross-sectional area of the primary manifold is also too small for the combined size of the rim outlet port area and jet outlet port area.

The toilet scored a 4 on the Bowl Scour Test at 1.6 gallons per flush. To assess the ability to flush on lower volumes of water, the water level in the tank was gradually lowered until the toilet failed to siphon consistently at 1.17 gallons. The Bowl Scour score at 1.17 gallons was reduced to 3.

Example 2 (Comparative)

Figure 12:
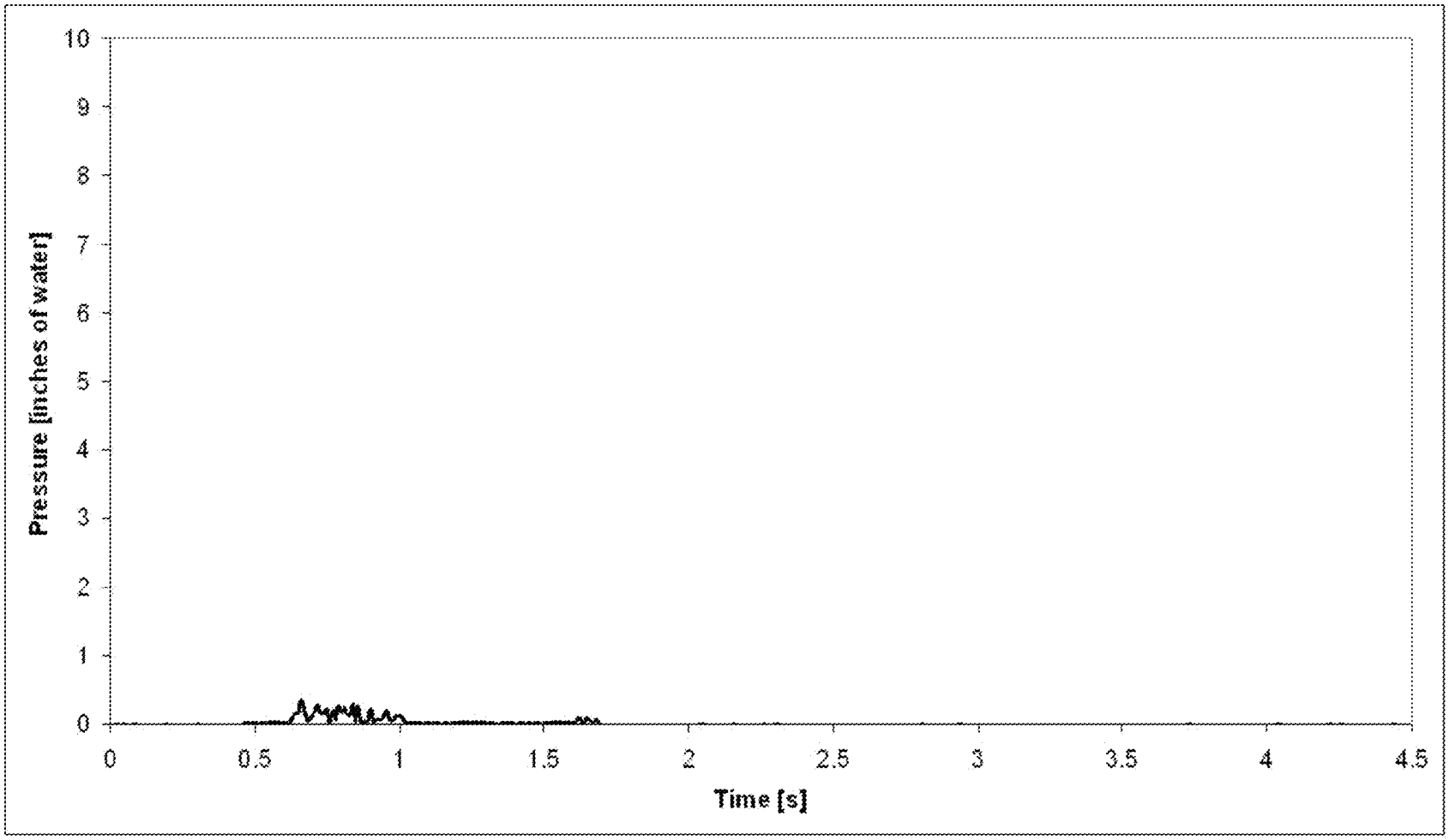
FIG. 12 is a graphical representation of the relationship of pressure ((measured in inches of water (in. $H_2O$)) versus time (measured in seconds) for Comparative Example 2.

A commercially available, 1.6 gallon per flush toilet with a single direct-fed jet was subjected to geometrical and performance analyses. The toilet is representative of many direct-fed jet toilets commercially available, in that the performance with respect to bulk removal is very good, scoring over 1,000 g on the MaP test (Veritec Consulting Inc., MaP 13th Edition November '08, Mississauga, ON, Canada), but the minimal water directed to the rim for bowl cleansing is not pressurized. FIG. 12 shows a plot of the pressure recorded in the rim during the flush cycle. No sustained pressure was observed, only a very week signal above the baseline due to dynamic fluctuations. The integral of pressure-time curve was 0.13 in. $H_2O$●s, indicating a nearly complete lack of pressurization.

In Table 3, the reason for the lack of rim pressurization is evident. The toilet fails to meet the criteria specified in this invention. The rim inlet port area is less that 2 times the rim outlet port area, and the cross-sectional area of the primary manifold is too small for the combined size of the rim outlet port area and jet outlet port area.

The toilet scored a 5 on the Bowl Scour Test at 1.6 gallons per flush. To assess the ability to flush on lower volumes of water, the water level in the tank was gradually lowered until the toilet failed to siphon consistently at 1.33 gallons. The Bowl Scour score at 1.33 gallons was reduced to 1.

Example 3 (Comparative)

Figure 13:
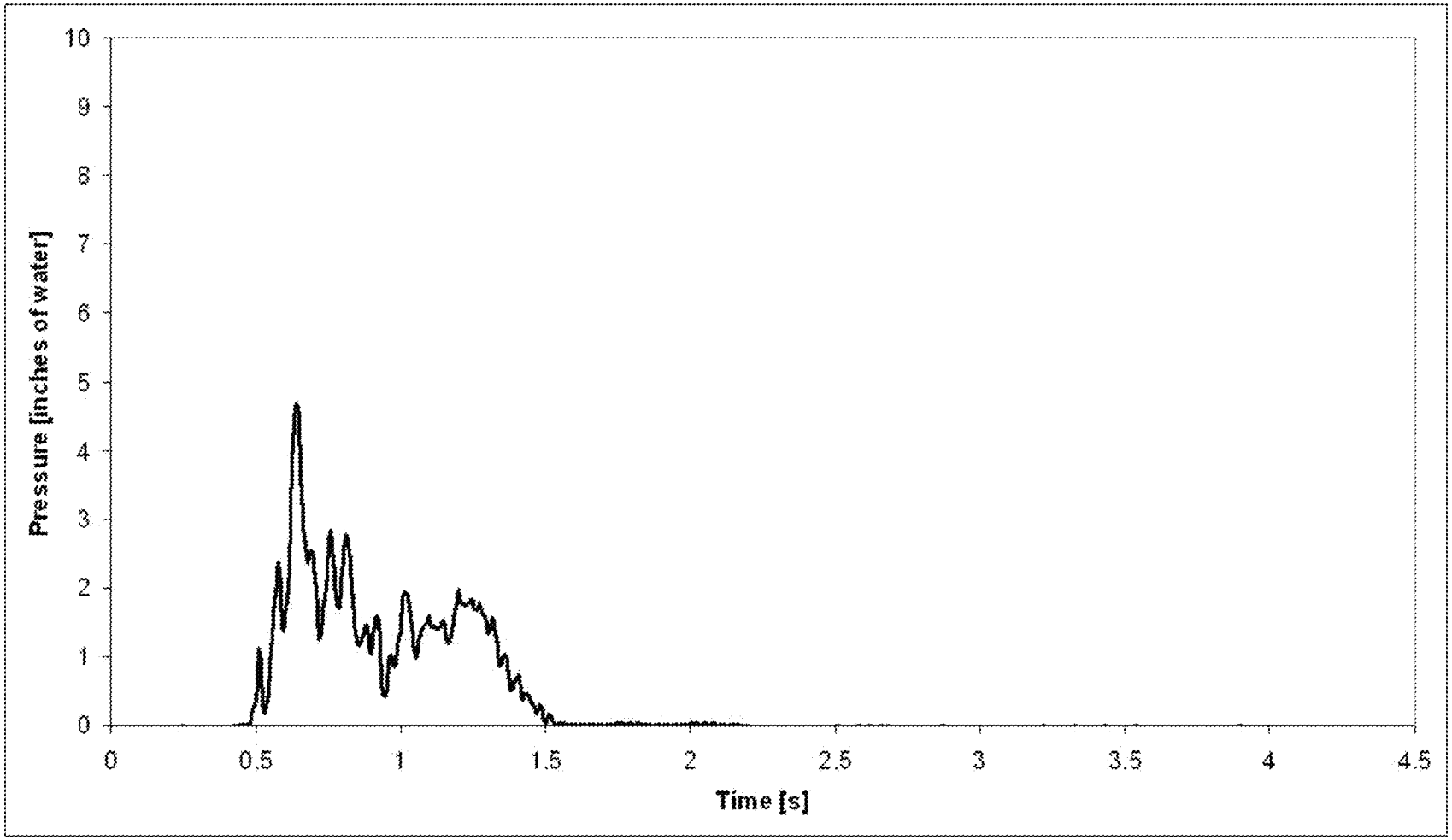
FIG. 13 is a graphical representation of the relationship of pressure ((measured in inches of water (in. $H_2O$)) versus time (measured in seconds) for Comparative Example 3.

A commercially available, 1.6 gallon per flush toilet with symmetrical, dual direct-fed jets was subjected to geometrical and performance analyses. The toilet is representative of many direct-fed jet toilets commercially available, in that the performance with respect to bulk removal is very good, scoring over 1,000 g on the MaP test (Veritec Consulting Inc., MaP 13th Edition November '08, Mississauga, ON, Canada), but the minimal water directed to the rim for bowl cleansing is not well pressurized. FIG. 13 shows a plot of the pressure recorded in the rim during the flush cycle. A weak, erratic signal was detected, but the maximum pressure sustained for at least one second was only 0.2 inches of $H_2O$. The integral of pressure-time curve was 1.58 in. $H_2O$●s, indicating minimal and ineffective pressurization.

In Table 3, the reason for the lack of rim pressurization is evident. The rim inlet port area is less that 2 times the rim outlet port area.

The toilet scored a 5 on the Bowl Scour Test at 1.6 gallons per flush. To assess the ability to flush on lower volumes of water, the water level in the tank was gradually lowered until the toilet failed to siphon consistently at 1.31 gallons. The Bowl Scour score at 1.31 gallons was reduced to 1.

Example 4 (Comparative)

Figure 14:
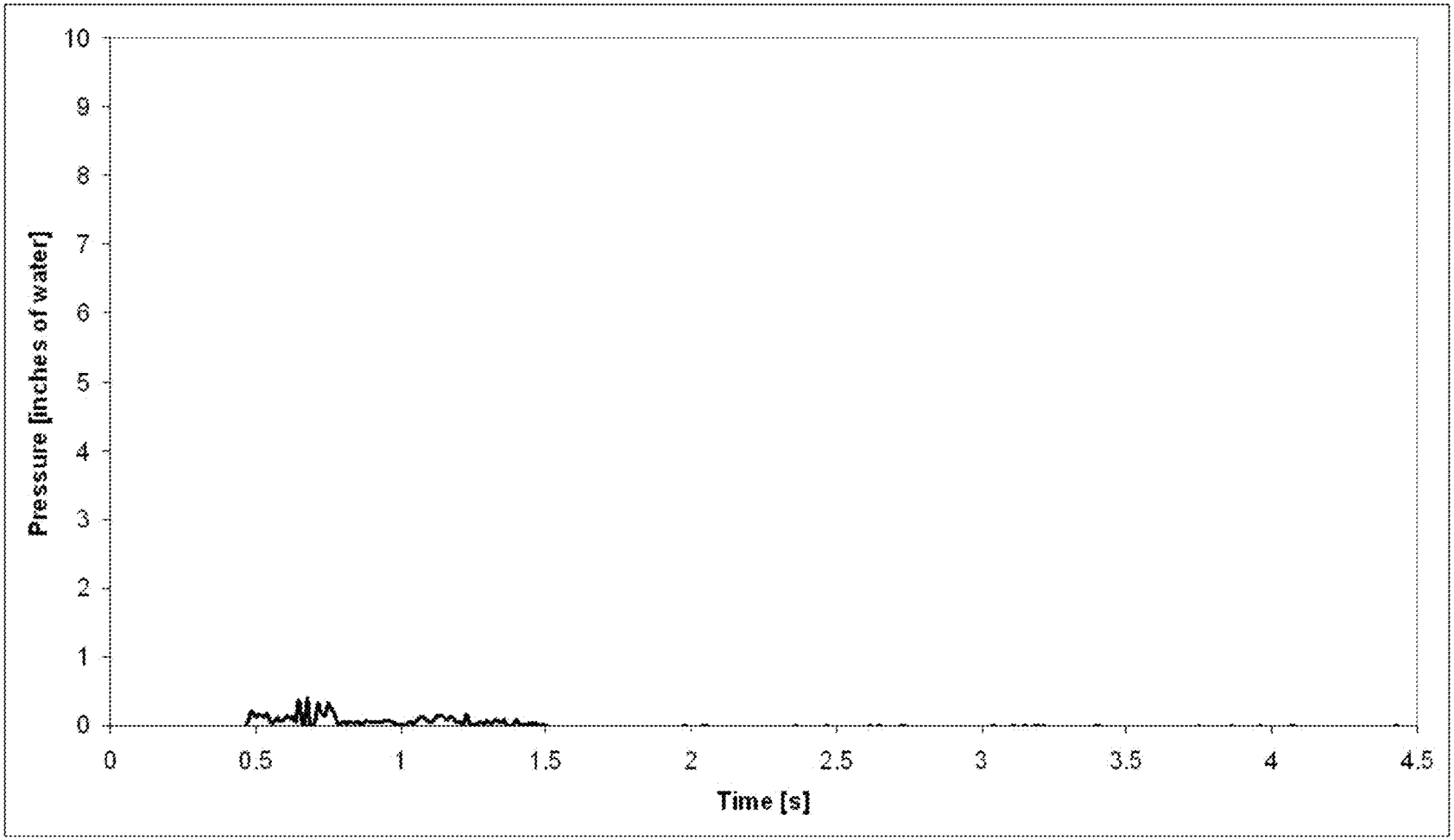
FIG. 14 is a graphical representation of the relationship of pressure ((measured in inches of water (in. $H_2O$)) versus time (measured in seconds) for Comparative Example 4.

A commercially available, 1.6 gallon per flush toilet with symmetrical, dual direct-fed jets was subjected to geometrical and performance analyses. The toilet is representative of many direct-fed jet toilets commercially available, in that the performance with respect to bulk removal is very good, scoring over 1,000 g on the MaP test (Veritec Consulting Inc., MaP 13th Edition November '08, Mississauga, ON, Canada), but the minimal water directed to the rim for bowl cleansing is not pressurized. FIG. 14 shows a plot of the pressure recorded in the rim during the flush cycle. No sustained pressure was observed, only a very week signal above the baseline due to dynamic fluctuations. The integral of pressure-time curve was 0.15 in. $H_2O$●s, indicating a nearly complete lack of pressurization.

In Table 3, the reason for the lack of rim pressurization is evident. The rim inlet port area is less that 2 times the rim outlet port area. In addition, the rim inlet port is positioned nearly parallel to the direction of flow, which greatly reduces its effective cross-sectional area.

The toilet scored a 5 on the Bowl Scour Test at 1.6 gallons per flush. To assess the ability to flush on lower volumes of water, the water level in the tank was gradually lowered until the toilet failed to siphon consistently at 1.31 gallons. The Bowl Scour score at 1.31 gallons was reduced to 4.

Example 5 (Comparative)

Figure 15:
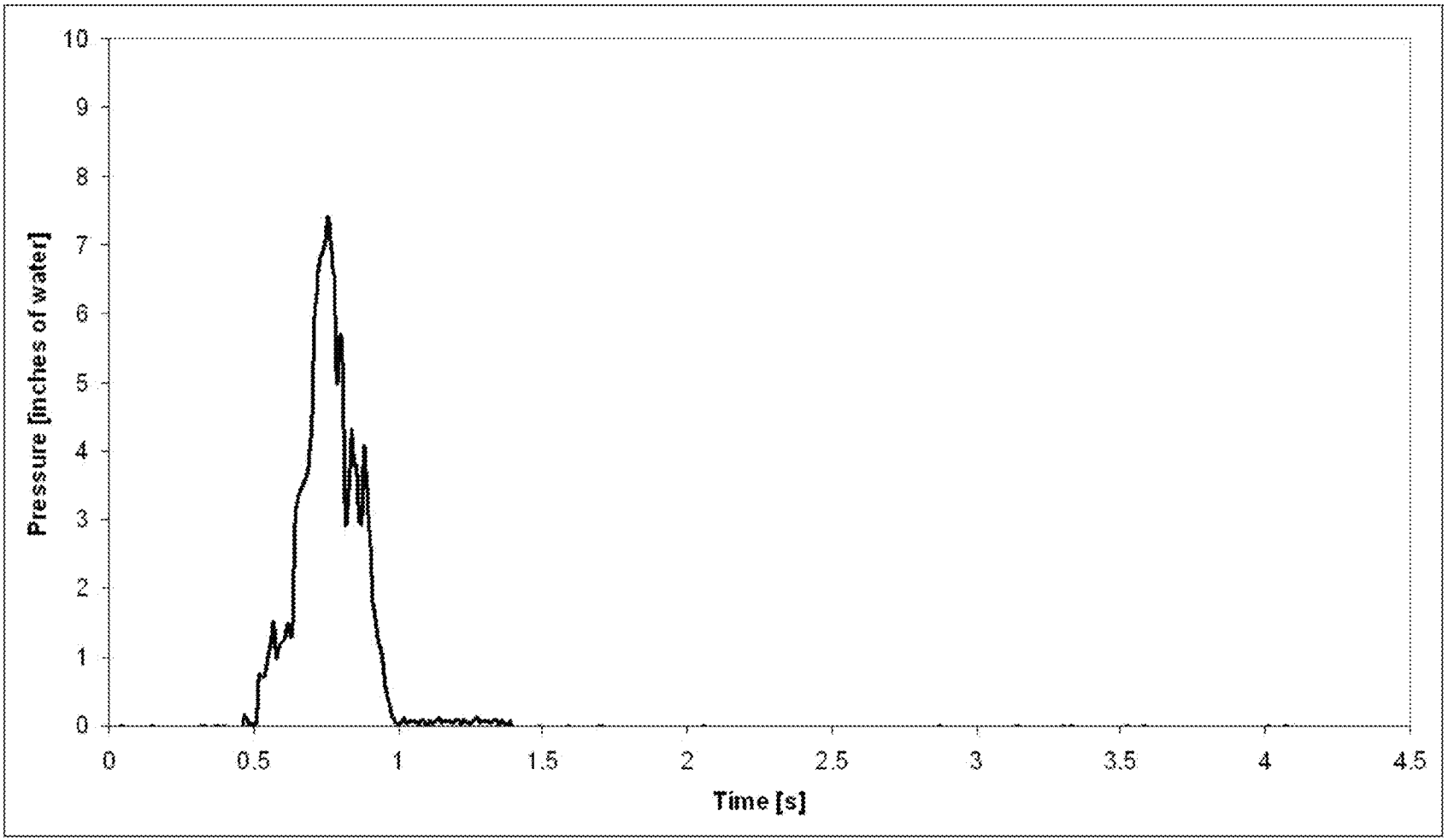
FIG. 15 is a graphical representation of the relationship of pressure ((measured in inches of water (in. $H_2O$)) versus time (measured in seconds) for Comparative Example 5.

A commercially available, 1.6 gallon per flush toilet with symmetrical, dual direct-fed jets was subjected to geometrical and performance analyses. The toilet is representative of many direct-fed jet toilets commercially available, in that the performance with respect to bulk removal is very good, scoring over 800 g on the MaP test (Veritec Consulting Inc., MaP 13th Edition November '08, Mississauga, ON, Canada), but the minimal water directed to the rim for bowl cleansing is not pressurized in a sustained manner. FIG. 15 shows a plot of the pressure recorded in the rim during the flush cycle. A short, erratic signal was detected, but no pressure above the baseline was sustained for at least one second. The integral of pressure-time curve was 1.11 in. $H_2O$●s, indicating minimal and ineffective pressurization.

In Table 3, the reason for the lack of rim pressurization is evident. The rim inlet port area is less that 2.5 times the rim outlet port area, which prevents the toilet from achieving a sustained rim pressure and the resultant jump in performance, even though all of the other parameters have been met.

The toilet scored a 5 on the Bowl Scour Test at 1.6 gallons per flush. To assess the ability to flush on lower volumes of water, the water level in the tank was gradually lowered until the toilet failed to siphon consistently at 1.39 gallons. The Bowl Scour score at 1.39 gallons was reduced to 2.

Example 6 (Comparative)

Figure 16:
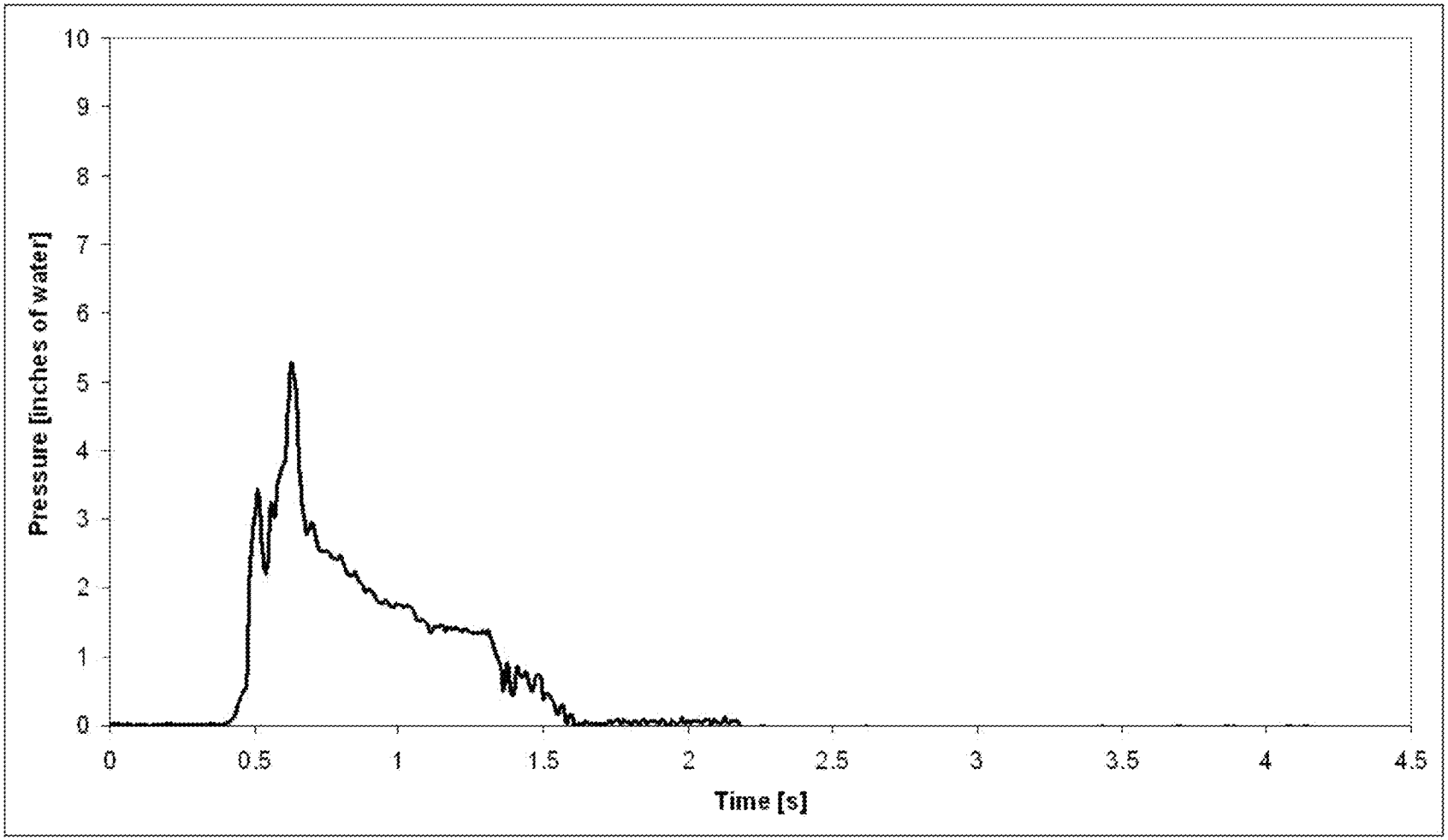
FIG. 16 is a graphical representation of the relationship of pressure ((measured in inches of water (in. $H_2O$)) versus time (measured in seconds) for Comparative Example 6.

A commercially available, 1.6 gallon per flush toilet with a single direct-fed jet was subjected to geometrical and performance analyses. The toilet is representative of many direct fed jet toilets commercially available, in that the performance with respect to bulk removal is very good, scoring over 700 g on the MaP test (Veritec Consulting Inc., MaP 13th Edition November '08, Mississauga, ON, Canada), but the minimal water directed to the rim for bowl cleansing is not pressurized. FIG. 16 shows a plot of the pressure recorded in the rim during the flush cycle. A weak signal was detected, but the maximum pressure sustained for at least one second was only 0.5 in. of $H_2O$. The integral of pressure-time curve was 2.13 in. $H_2O$●s, minimal and ineffective pressurization.

In Table 3, the reason for the minimal rim pressurization is evident. The rim inlet port area is less that 2.5 times the rim outlet port area, which prevents the toilet from achieving a sustained rim pressure and the resultant jump in performance, even though all of the other parameters have been met. It is instructive to observe that the port sizes of the toilet of Example 6 are fairly similar to those of the toilet of Example 4, yet the former has a pressure time integral that is nearly 15 times greater than the latter. The reason for this is the orientation of the ports as discussed above. The primary manifold in the toilet of Example 4 slopes downward towards the jet inlet port, which directs the flow of water away from the rim inlet port, decreasing its effective cross-sectional area. The toilet of Example 6 has a horizontal primary manifold, similar to that shown in FIG. 1.

The toilet scored a 5 on the Bowl Scour Test at 1.6 gallons per flush. To assess the ability to flush on lower volumes of water, the water level in the tank was gradually lowered until the toilet failed to siphon consistently at 1.28 gallons. The Bowl Scour score at 1.28 gallons was reduced to 3.

Example 7 (Inventive)

Figure 17:
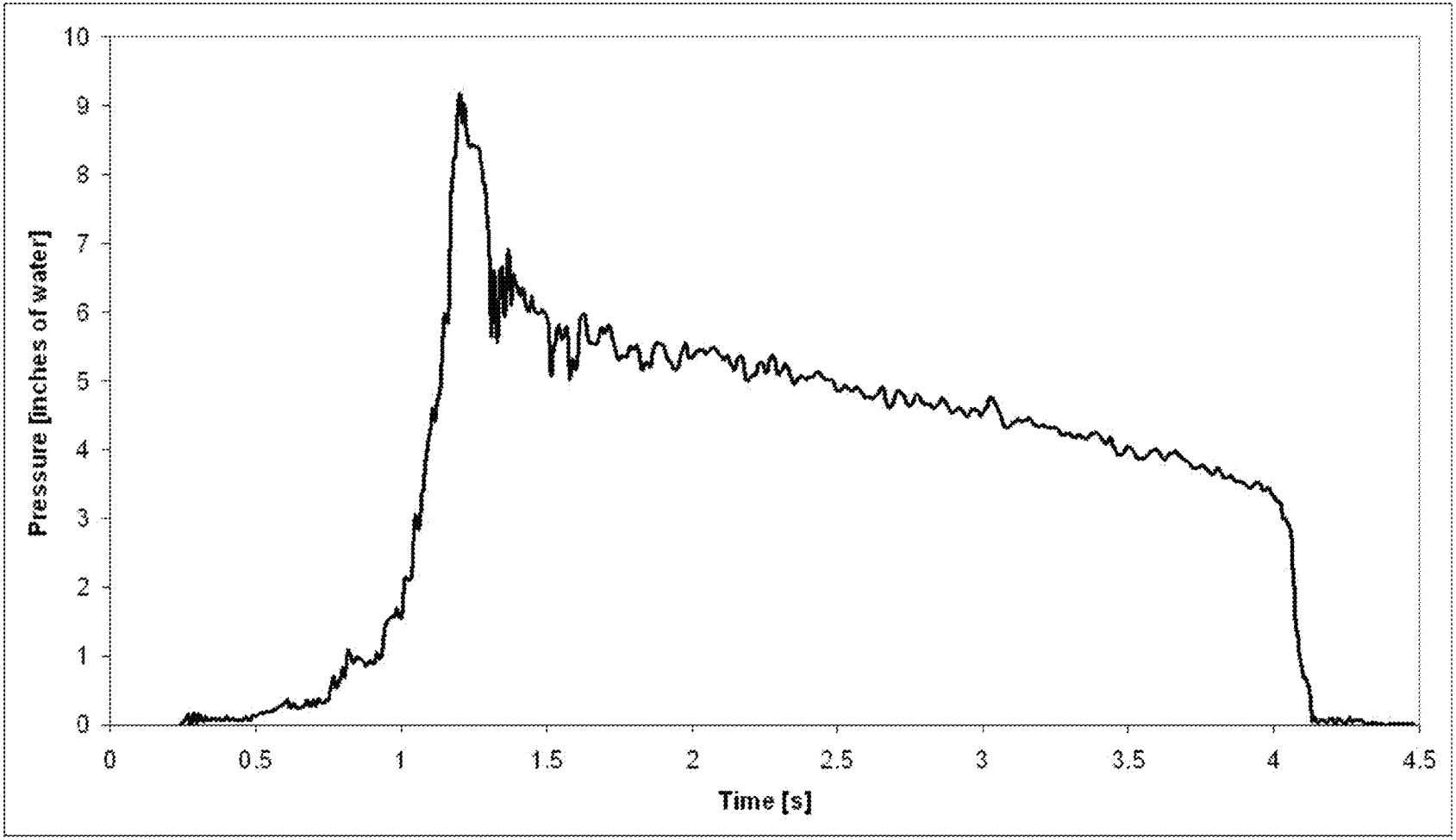
FIG. 17 is a graphical representation of the relationship of pressure ((measured in inches of water (in. $H_2O$)) versus time (measured in seconds) for Example 7.

A 1.6 gallon per flush toilet with dual direct-fed jets was fabricated according to a preferred embodiment of the invention. The toilet geometry and design were identical to that represented in FIGS. 1 and 3. The toilet's performance in bulk removal is similar to the commercially available examples above, capable of scoring 1000 g on the MaP test. As seen in Table 3, the internal geometry of all of the ports and channels in the hydraulic pathway are within the limits specified by this invention. The cross-sectional area of the primary manifold was 6.33 $in^2$, the jet inlet port area was 4.91 $in^2$, the rim inlet port area was 2.96 $in^2$, the jet outlet port area was 1.24 $in^2$, and the rim outlet port area was 0.49 $in^2$. The critical ratios between the port sizes were also maintained: The ratio of the cross-sectional area of the primary manifold to the sum of the rim and jet outlet ports was 3.66. And the ratio of the rim inlet port area to rim outlet port area was 6.04, well above the Comparative Examples. As seen in FIG. 17, a strong, sustained pressure was measured in the rim during the flush cycle. A pressure of 5 in. $H_2O$ was maintained for at least one second and the integral of the pressure-time curve was 15.3, well exceeding the values seen in the prior art.

The toilet scored a 5 on the Bowl Scour Test at 1.6 gallons per flush. To assess the ability to flush on lower volumes of water, the water level in the tank was gradually lowered until the toilet failed to siphon consistently at 0.81 gallons. The Bowl Scour score at 0.81 gallons was reduced to 4. However, when the flush volume was increased to 1.17 gallons, the minimum flush volume obtained in Examples 1-6, the Bowl Scour Score was maintained at the maximum value of 5. It should also be noted that in dual flush applications, the bowl cleaning ability is less critical, since it is assumed that the low volume cycle will be used for liquid waste only. A consistent siphon achieved as low as 0.81 gallons makes this toilet ideally suited for dual flush applications.

Examples 8-12

Inventive

CFD simulations were performed to further demonstrate the scope and utility of the invention. The general design of the toilets studied in CFD is that illustrated in FIGS. 1 and 3. However, specific dimensions were varied to show the resultant impact on flush performance and pressure generated and maintained in the rim of the toilet. The first set of simulations used a flush valve with a 2 in. diameter outlet, corresponding to a flush valve outlet area of 3.14 $in^2$. While holding the flush valve outlet area constant, the cross-sectional area of the entire hydraulic pathway (that is, the cross-sectional area of the primary manifold, rim inlet port, jet inlet port, rim channel, and jet channel) was varied between a high and low setting. Likewise, the jet port and rim port areas were varied between high and low settings to create a 22 designed experiment. Adding a point close to the center of the space resulted in the five CFD simulations shown as Examples 8-12 in Table 3 and in FIG. 5.

Figure 5:
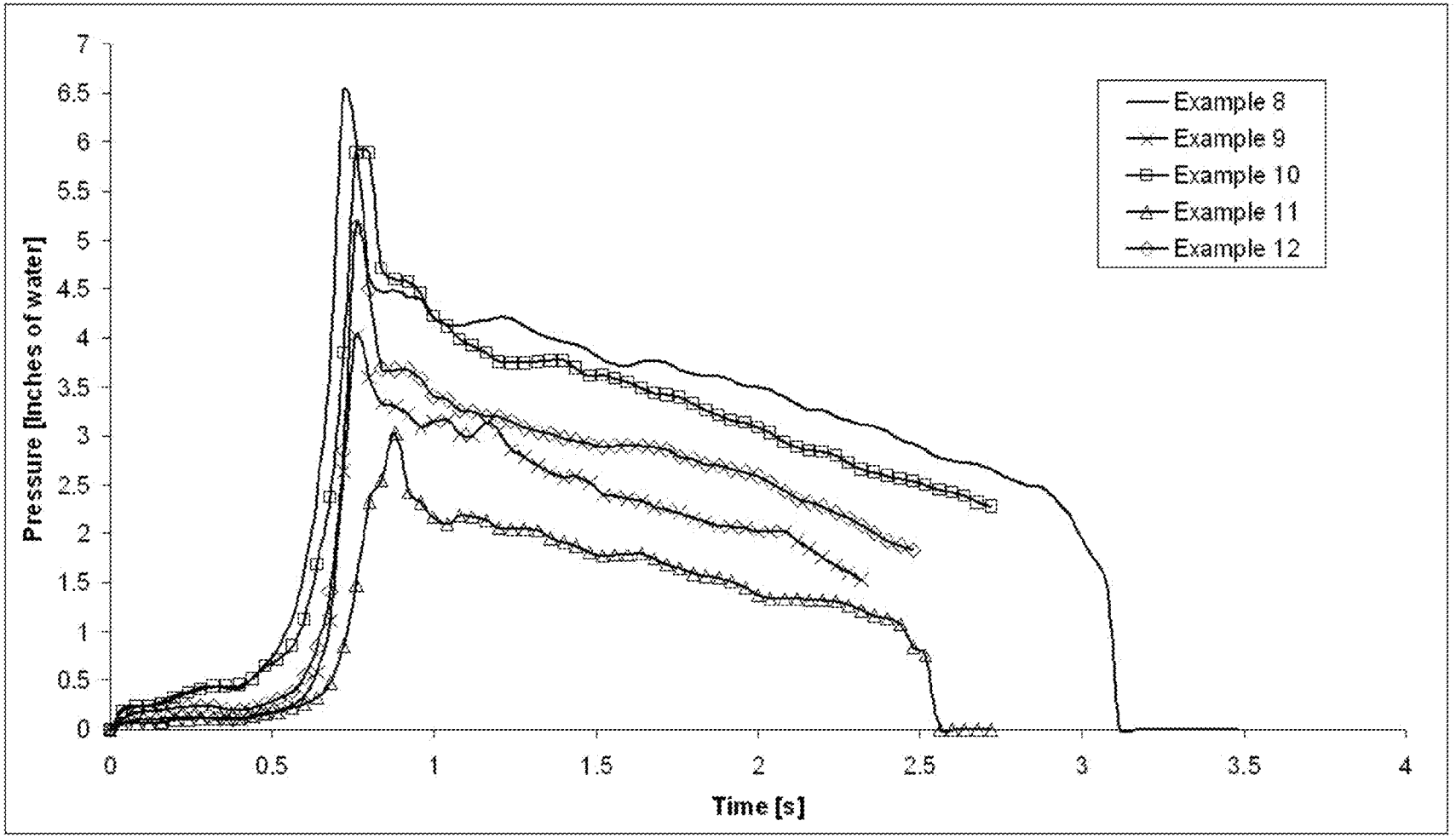
FIG. 5 is graphical representation of the relationship of pressure (measures in inches of water (in. $H_2O$)) versus time (measured in seconds) for data from Examples 8-12.
Figure 7:
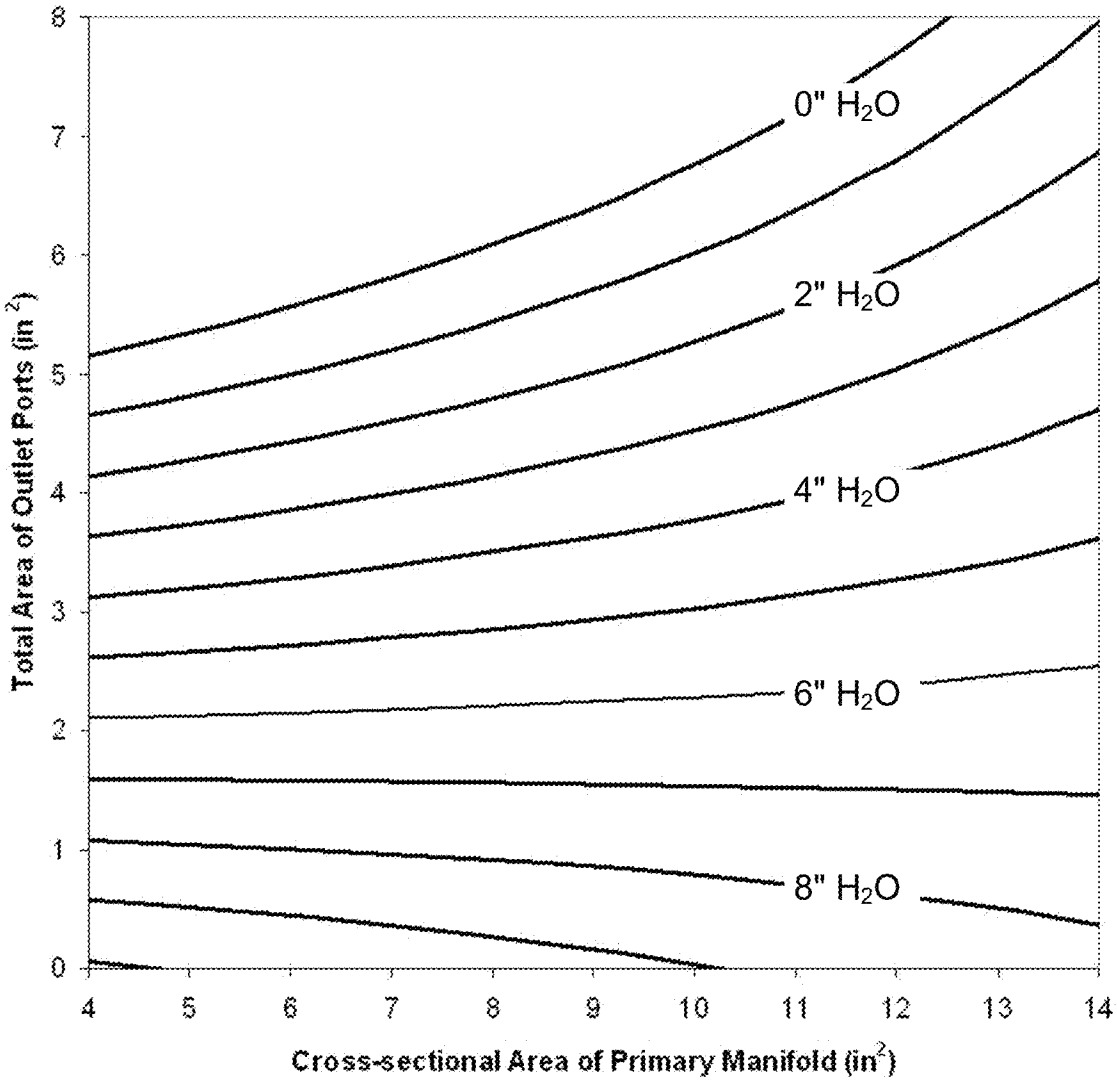
FIG. 7 is a graphical representation of the relationship of the total area of outlet ports (measured in $in^2$) versus cross-sectional area of the primary manifold (measured in $in^2$) for Examples 8-12.

As can be seen in Table 3 and FIG. 5, rim pressurization to above 1 inch of water was sustained for nearly 2 seconds in all cases. The trends observed are more instructive, and support the assertions of this invention. Rim pressure increases as the jet outlet port area and rim outlet port areas are decreased. FIG. 7 shows a contour plot of peak rim pressure as a function of total rim and jet outlet port area and total cross-section of the hydraulic pathway. Reducing the jet outlet port area and rim outlet port areas has a strong positive effect on the maximum rim pressure. Likewise, reducing the cross-sectional area of the entire hydraulic pathway has a positive effect. This is because a larger hydraulic pathway requires more water to fill it, and this water used to fill the chamber is inefficient use of the available energy. The hydraulic pathway needs to be optimally sized to handle the flow output of the flush valve. Following the guidelines outlined in this invention allow this optimum to be achieved.

Figure 6:
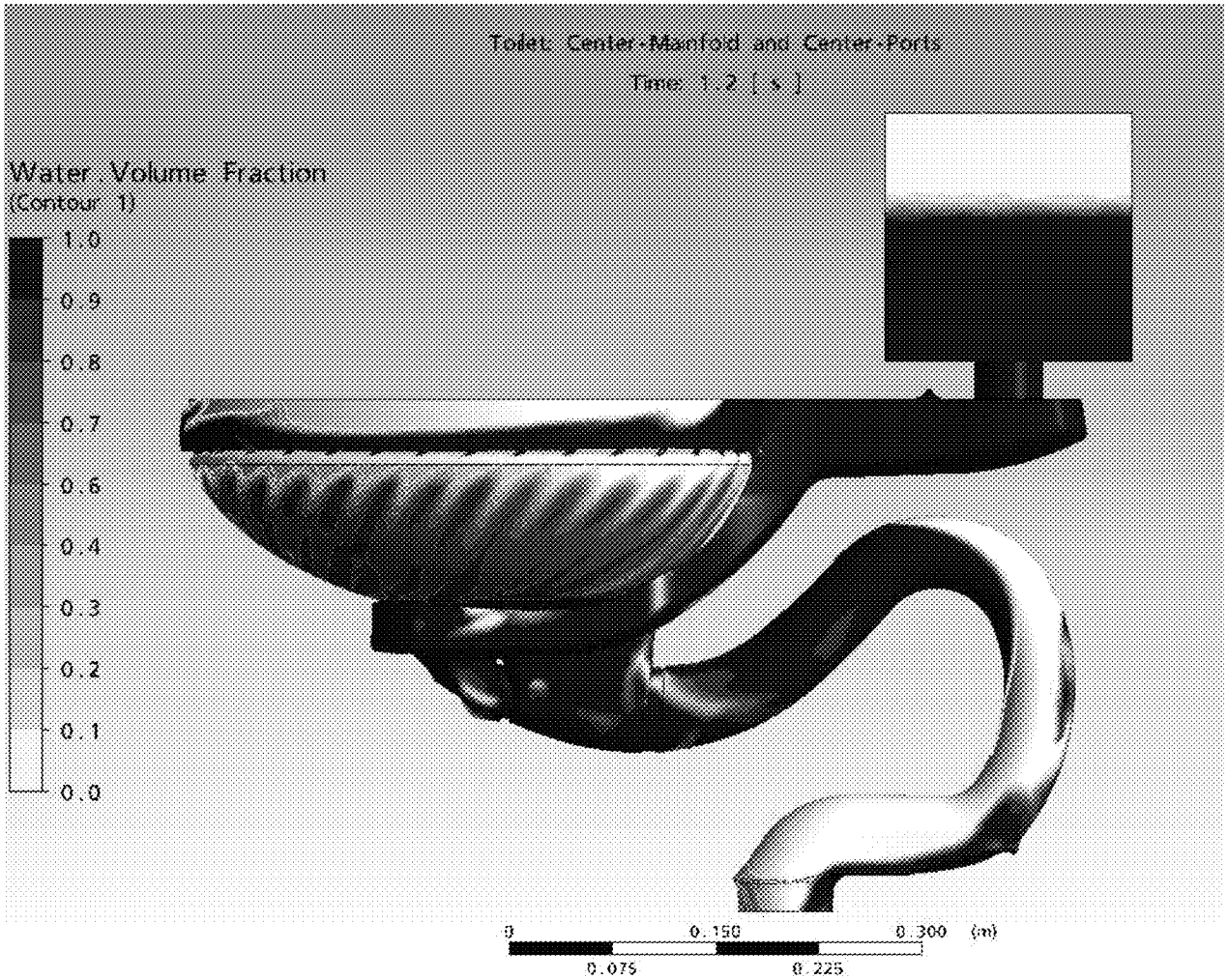
FIG. 6 is side view of a CFD simulation at the center point of the experiments in Examples 8-12, i.e., Example 12, at 1.2 seconds into the flush cycle.

FIG. 6 shows a side view of the computational fluid dynamics simulation for the center point of the experiments, Example 12, at 1.2 seconds into the flush cycle. It can be seen that the lower section of the rim is covered by water. Flow is restricted by the size of the rim outlet ports and pressure builds in the air above the water in the rim. The result is an even, powerful rim wash which can be seen in the bowl portion of the simulation.

It should be noted that the toilet described in Example 7 falls within the space of this Computational Fluid Dynamics experiment. Based on the CFD-derived contour plot in FIG. 7, the toilet of Example 7 should have a peak rim pressure of 6-7 inches of water, which is somewhat lower than the experimentally measured value of around 9 inches of water. However, the agreement in the general shape of the pressure-time curves is outstanding, and strongly supports the invention's guidelines for superior toilet design.

Examples 13-17

Inventive

Figure 8:
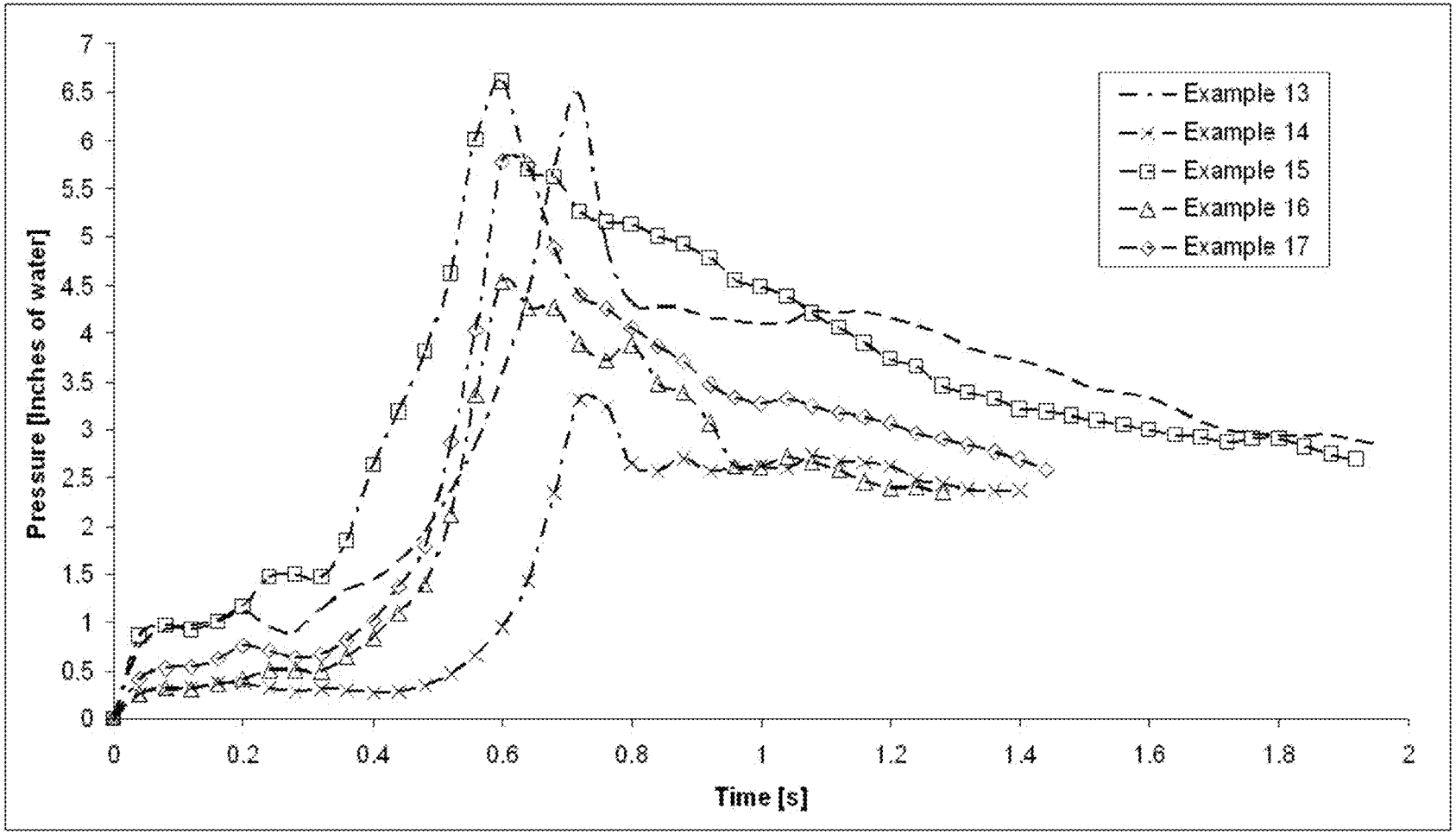
FIG. 8 is a graphical representation of the relationship of pressure (measured in inches of water (in. $H_2O$)) versus time (measured in seconds) for data from Examples 13-17.

Additional CFD simulations were performed to further demonstrate the scope and utility of the invention. The general design of the toilets studied in CFD is that illustrated in FIGS. 1 and 3. However, specific dimensions were varied to show the resultant impact on flush performance and pressure generated and maintained in the rim of the toilet. This second set of simulations used a flush valve with a 3 inch diameter outlet, corresponding to a flush valve outlet area of 7.06 $in^2$. The trapway size was also increased to take advantage of the higher flow achievable with a 3 inch valve. While holding the flush valve outlet area constant, the cross-sectional area of the entire hydraulic pathway (that is, the cross-sectional area of the primary manifold, rim inlet port, jet inlet port, rim channel, and jet channel) was varied between a high and low setting. Likewise, the jet port and rim port areas were varied between high and low settings to create a 22 designed experiment. Adding a point close to the center of the space resulted in the five CFD simulations shown as Examples 13-17 in Table 3 and in FIG. 8.

Figure 10:
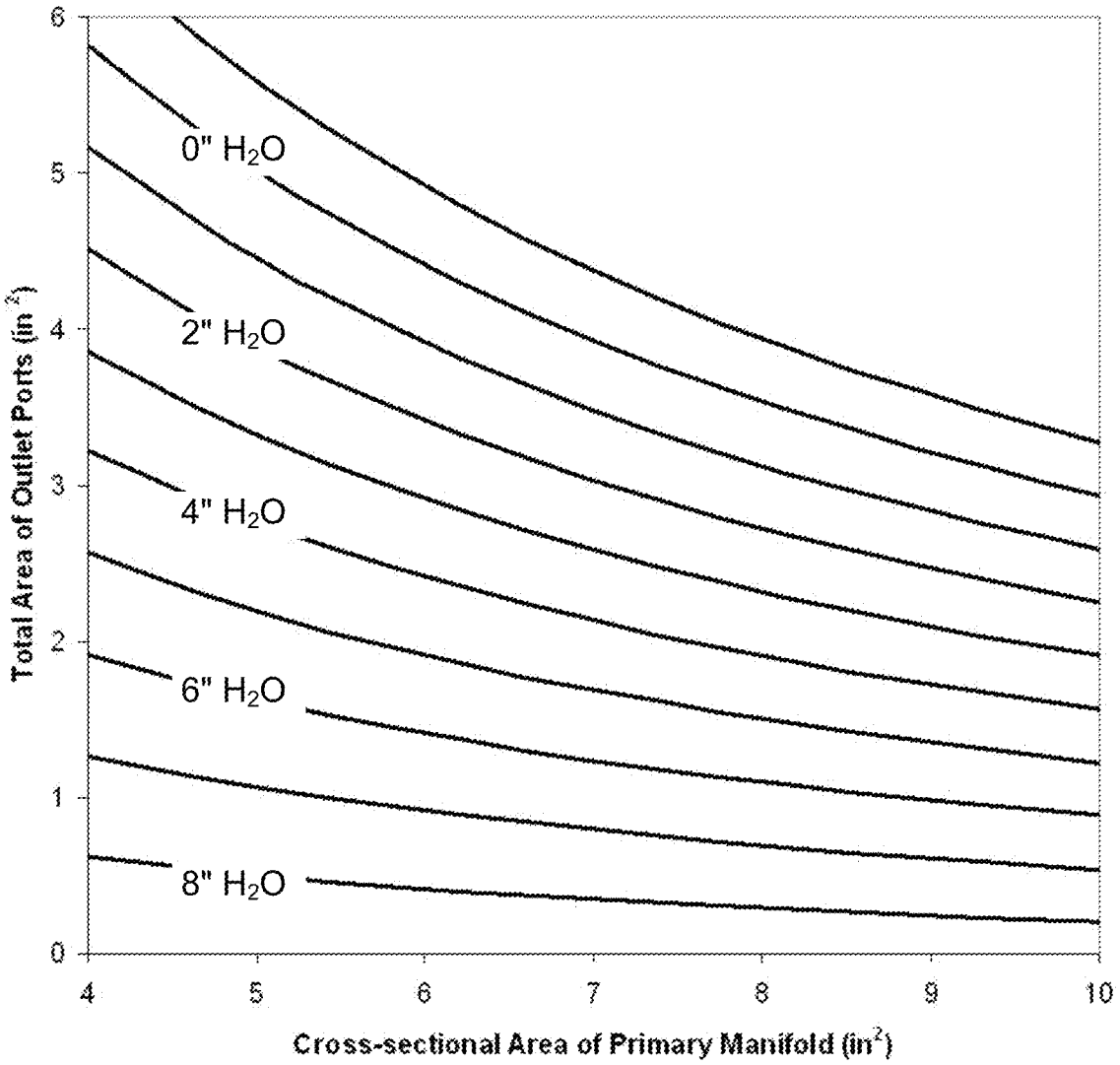
FIG. 10 is a graphical representation of the relationship of the total area of outlet ports (measured in $in^2$) versus cross-sectional area of the primary manifold (measured in $in^2$) for Examples 13-17.

To reduce computation time, the simulations were not run to completion. But as can be seen in Table 3 and FIG. 8, sustained rim pressurization was achieved in all cases. The trends observed are more instructive, and support the assertions of this invention. Rim pressure increases as the jet outlet port area and rim outlet port areas are decreased. FIG. 10 shows a contour plot of peak rim pressure as a function of total rim and pet outlet port area and total cross-section of the hydraulic pathway. Reducing the jet outlet port area and rim outlet port areas has a strong positive effect on the maximum rim pressure. However, unlike the simulations for the 2 inch valve, reducing the cross-sectional area of the entire hydraulic pathway has a negative effect on the rim pressure. This is because a larger hydraulic pathway is required to optimally handle the greater flow output of a 3 inch flush valve. The settings chosen for the high and low in the 3 inch flush valve simulations were below the theoretical optimal value for the cross-sectional area of the entire hydraulic pathway, whereas the settings chosen for the 2 inch simulations were slightly above this optimum. However, throughout the range, performance of the resultant toilet designs would outperfoim those currently available in terms of bulk removal and cleanliness at reduced flush volumes.

Figure 9:
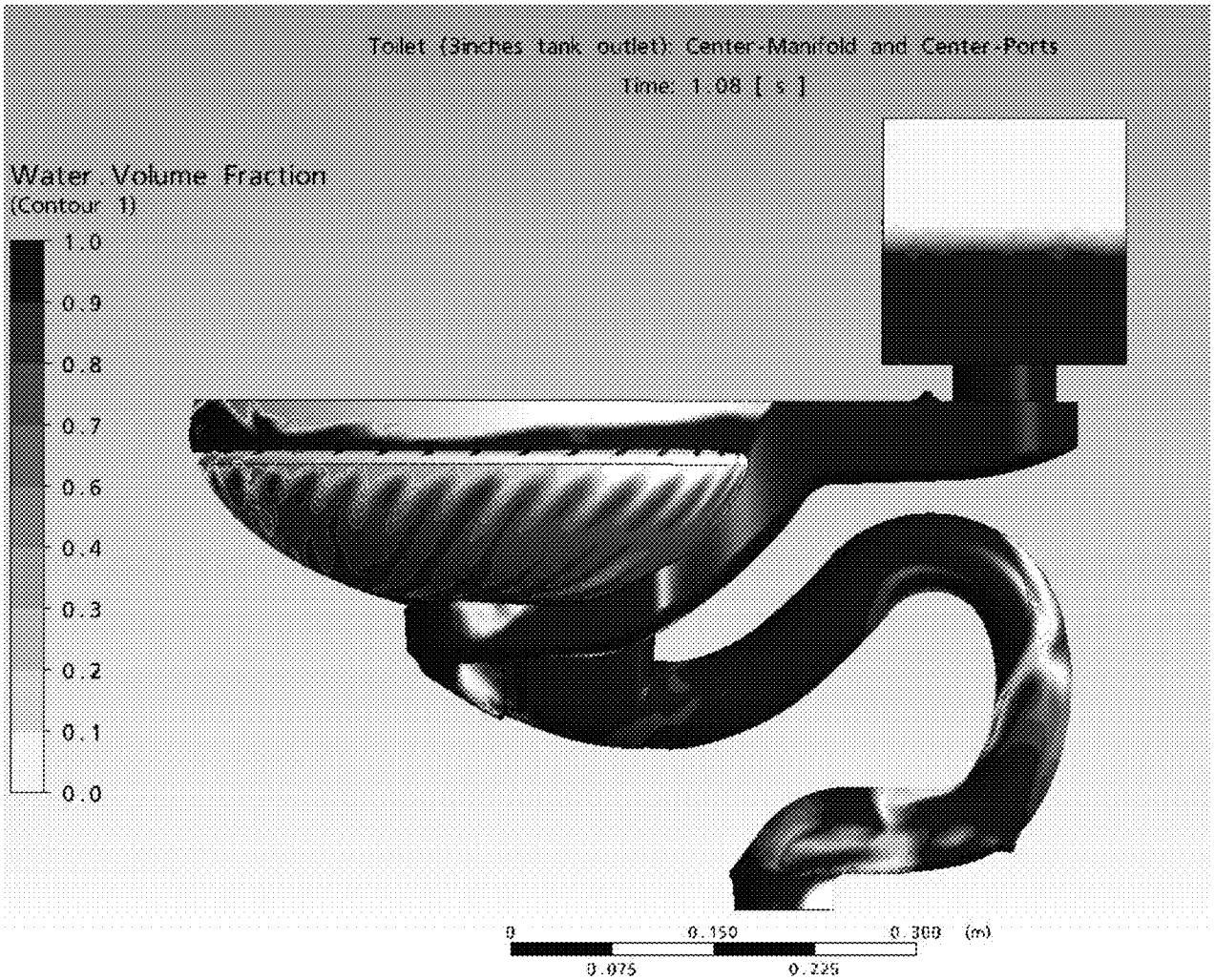
FIG. 9 is a side view of a CFD simulation for the center point of the experiments in Examples 13-17, Example 17, at 1.08 seconds into the flush cycle

FIG. 9 shows a side view of the computational fluid dynamics simulation for the center point of the experiments, Example 17, at 1.08 seconds into the flush cycle. It can be seen that the lower section of the rim is covered by water. Flow is restricted by the size of the rim outlet ports and pressure builds in the air above the water in the rim. The result is an even, powerful rim wash which can be seen in the bowl portion of the simulation. Taken as a whole, the data from Examples 13-17 show that the invention is scalable through all potential geometries for direct jet toilets that operate at or below 1.6 gallons per flush.

Example 18

Inventive

Figure 18:
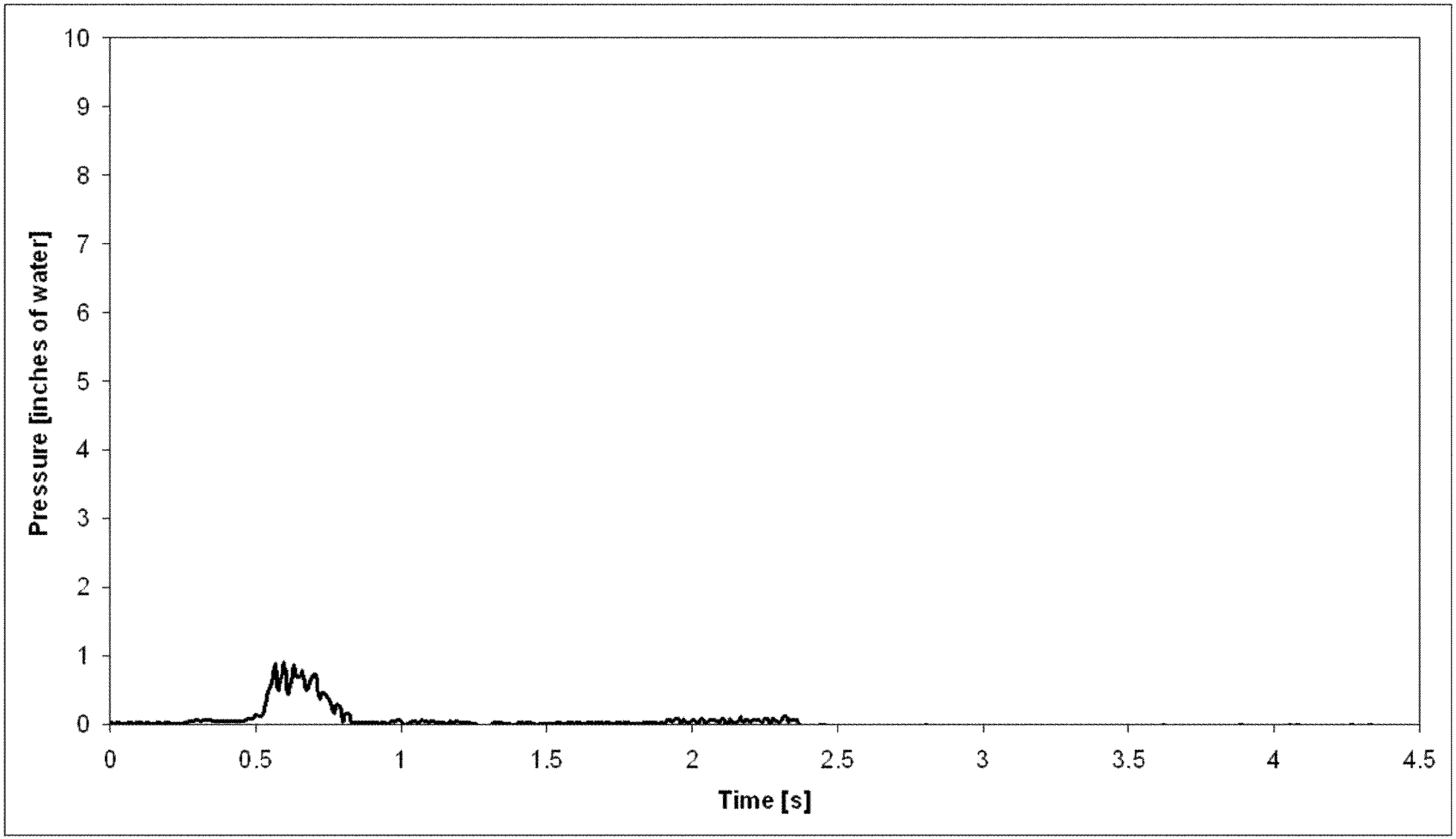
FIG. 18 is a graphical representation of the relationship of pressure ((measured in inches of water (in. $H_2O$)) versus time (measured in seconds) for the prior art toilet referenced in Example 18, both at 1.28 gallons/flush.
Figure 19:
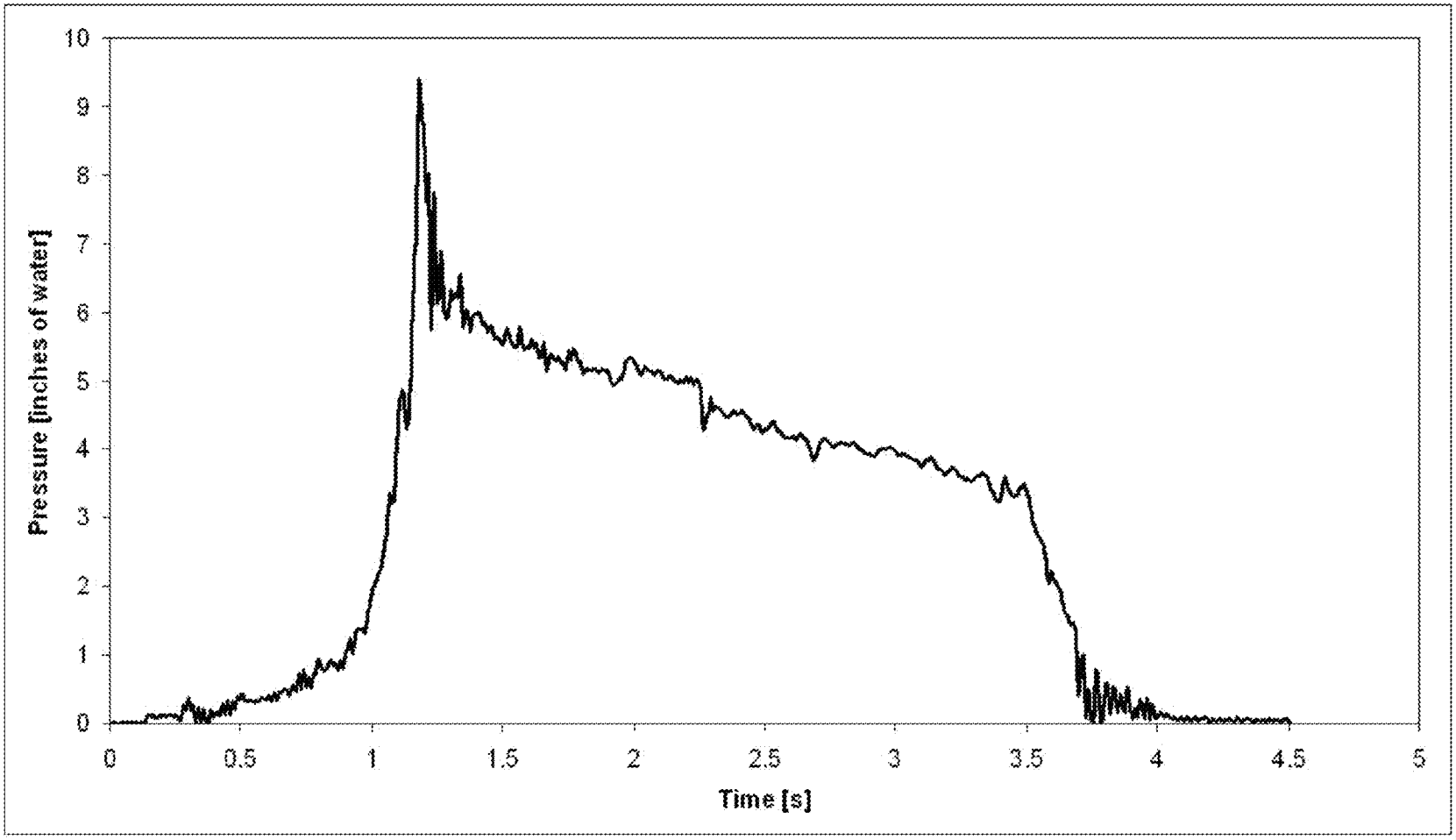
FIG. 19 is a graphical representation of the relationship of pressure ((measured in inches of water (in. $H_2O$)) versus time (measured in seconds) for the inventive toilet of Example 18.

To demonstrate the effectiveness of the invention, pressure in the rim for a toilet made under the present invention (Example 7) and a toilet from the prior art (Example 6) was measured with a reduced flush volume of 1.28 gallons. The toilet of the prior art, which pressurized to 2.13 in. $H_2O$·s at 1.6 gallons, lost nearly all of its ability to pressurize at the reduced volume, decaying to 0.28 in. $H_2O$·s (See FIG. 18). In contrast, the toilet under the present invention lost less than 20% of its pressurization, maintaining 12.64 in $H_2O$·s at 1.28 gallons per flush (See FIG. 19).

TABLE 3

| | | Area of Flush Valve Outlet ($in^2$) | Cross-Sectional Area of Primary Manifold ($in^2$) | Jet Inlet Port Area ($in^2$) | Rim Inlet Port Area ($in^2$) | Jet Outlet Port Area ($in^2$) | Rim Outlet Port Area ($in^2$) | Apm/ (Ajop + Arop) | Arip/ Arop | Sump Volume (mL) |
|---|---|---|---|---|---|---|---|---|---|---|
| Example 1 | Prior Art | 7.08 | 4.26 | 4.53 | 1.59 | 1.59 | 3.31 | 0.87 | 0.48 | 2700 |
| Example 2 | Prior Art | 7.08 | 8.75 | 5.80 | 6.91 | 3.02 | 4.57 | 1.15 | 1.51 | 3000 |
| Example 3 | Prior Art | 7.08 | 10.01 | 3.67 | 1.40 | 1.68 | 1.06 | 3.65 | 1.32 | 3000 |
| Example 4 | Prior Art | 8.30 | 8.80 | 6.98 | 1.93 | 1.45 | 2.06 | 2.51 | 0.94 | 2900 |

TABLE 3-continued

| | | | | | | | | | | |
|---|---|---|---|---|---|---|---|---|---|---|
| Example 5 | Prior Art | 7.08 | 7.58 | 2.78 | 1.53 | 1.24 | 0.77 | 3.77 | 1.99 | 2750 |
| Example 6 | Prior Art | 7.08 | 8.27 | 4.30 | 3.55 | 1.84 | 1.99 | 2.16 | 1.78 | 2800 |
| Example 7 | Present Invention | 3.15 | 6.33 | 4.91 | 2.96 | 1.24 | 0.49 | 3.66 | 6.04 | 2400 |
| Example 8 | Present Invention | 3.15 | 5.93 | 5.05 | 5.81 | 1.1 | 0.56 | 3.57 | 10.38 | 2115 |
| Example 9 | Present Invention | 3.15 | 5.93 | 5.05 | 5.81 | 1.85 | 1.05 | 2.04 | 5.53 | 2115 |
| Example 10 | Present Invention | 3.15 | 7.28 | 6.41 | 6.39 | 1.1 | 0.56 | 4.39 | 11.41 | 2115 |
| Example 11 | Present Invention | 3.15 | 7.28 | 6.41 | 6.39 | 1.85 | 1.05 | 2.51 | 6.09 | 2115 |
| Example 12 | Present Invention | 3.15 | 6.61 | 5.72 | 6.29 | 1.47 | 0.81 | 2.90 | 7.77 | 2115 |
| Example 13 | Present Invention | 7.08 | 7.31 | 6.64 | 6.53 | 1.38 | 0.56 | 3.77 | 11.66 | 2115 |
| Example 14 | Present Invention | 7.08 | 7.31 | 6.64 | 6.53 | 2.83 | 1.05 | 1.88 | 6.22 | 2115 |
| Example 15 | Present Invention | 7.08 | 12.73 | 10.85 | 11.83 | 1.38 | 0.56 | 6.56 | 21.13 | 2115 |
| Example 16 | Present Invention | 7.08 | 12.73 | 10.85 | 11.83 | 2.83 | 1.05 | 3.28 | 11.27 | 2115 |
| Example 17 | Present Invention | 7.08 | 9.99 | 8.18 | 8.37 | 2.1 | 0.81 | 3.43 | 10.33 | 2115 |

| | | Trap Diameter (in) | Trap Volume (mL) | Maximum Pressure in Rim During Flush Cycle (inches of $H_2O$) | Maximum rim pressure sustained for >1 s (inches of water) | Integral of Pressure vs Time Plot (Inches of H2O * s) | Peak Flush Discharge Rate (mL/s) | Tim to Peak Flush Discharge Rate (s) |
|---|---|---|---|---|---|---|---|---|
| Example 1 | Prior Art | 2.06 | 2100 | 0.1 | 0.0 | 0.19 | 3248 | 1.10 |
| Example 2 | Prior Art | 2.25 | 2850 | 0.0 | 0.0 | 0.13 | 3984 | 0.80 |
| Example 3 | Prior Art | 1.94 | 1550 | 0.8 | 0.2 | 1.58 | 3416 | 0.80 |
| Example 4 | Prior Art | 2.00 | 2200 | 0.1 | 0.0 | 0.15 | 3710 | 1.37 |
| Example 5 | Prior Art | 2.06 | 2000 | 2.1 | 0.0 | 1.11 | 3660 | 1.30 |
| Example 6 | Prior Art | 2.00 | 1950 | 0.1 | 0.5 | 2.13 | 3664 | 1.35 |
| Example 7 | Present Invention | 1.94 | 1700 | 5.0 | 5.0 | 15.30 | 3120 | 1.40 |
| Example 8 | Present Invention | 2.00 | 1664 | 6.49 | 3.7 | N/A | N/A | N/A |
| Example 9 | Present Invention | 2.00 | 1664 | 4.02 | 2.2 | N/A | N/A | N/A |
| Example 10 | Present Invention | 2.00 | 1664 | 5.89 | 3.3 | N/A | N/A | N/A |
| Example 11 | Present Invention | 2.00 | 1664 | 3.03 | 1.6 | N/A | N/A | N/A |
| Example 12 | Present Invention | 2.00 | 1664 | 5.12 | 2.8 | N/A | N/A | N/A |
| Example 13 | Present Invention | 2.25 | 1960 | 6.48 | 3.0 | N/A | N/A | N/A |
| Example 14 | Present Invention | 2.25 | 1960 | 3.30 | N/A | N/A | N/A | N/A |
| Example 15 | Present Invention | 2.25 | 1960 | 6.61 | 3.0 | N/A | N/A | N/A |
| Example 16 | Present Invention | 2.25 | 1960 | 4.54 | N/A | N/A | N/A | N/A |
| Example 17 | Present Invention | 2.25 | 1960 | 5.78 | N/A | N/A | N/A | N/A |

Examples 19-36

Additional CFD simulations were performed to further demonstrate the scope and utility of the invention. The general design of the prototype toilets studied in these CFD Examples is that illustrated in FIGS. 20-22. However, specific dimensions were varied to show the resultant impact on flush performance and pressure generated and maintained in the rim of the toilet. The trap configuration varied using 6 different trap diameters, while the tank head was kept constant at 7 inches. As noted in Table 4, for each of the different trap diameters (e.g., 1.9375 in. for the trap used in Examples 19-21 and 28-30; 2.0625 in. for the trap used in Examples 22-24 and 31-33; and 2.1875 in. for the trap used in Examples 25-27 and 34-36, wherein the trap diameter noted is the smallest diameter (ball pass diameter) measured along the trapway), three different jet diameters were used 1.14 in., 1.26 in. and 1.38 in. (29 mm, 32 mm and 36 mm, respectively). A series of about 30 flushing measurements were made for each configuration using the prototype design and the CFD experimental parameters. Aside from prototype equipment or experimental error, all trials run according to the protocol without error or malfunction were averaged and the data reported herein as set forth in Table 4.

For all Examples herein, the rim included 32 ports measuring about 3 mm for about 0.49 square inch rim outlet port area. The jet had one port having a 30 mm jet outlet of about a 1.1 square inch area. The flush valve was a Fluidmaster® #540 with a three-inch, flapper-style flush valve. The measurements of the various parameters approximate those of the preferred parameters in Table 2 herein.

Various simulation tests were run using a number of trials with the average data being reported in Table 4. The various examples also included flushing a number of various items as noted in Table 4 through the simulation designs with the average data being reported for the number of golf balls, polymer balls, test napkins and ping pong balls which passed through the pathway after flushing. With respect to the golf balls, each had a diameter of 1.68 inches and a weight of 44.5 grams. Twenty balls were used in the testing. For the polymer ball test, 350 ¾ inch polymer balls were flushed and the amount remaining after flushing was recorded. The napkin test utilized Maratuff® light duty wipers measuring about 12.5"×14.5" and 9.5 grams (+/−5%) and the results indicate the number of napkins that passed through the bowl after flushing. The ping pong test used standard one and a half inch ping pong balls and the results indicate the number of balls passing through the bowl in a single flush.

Additionally, the testing measured the parameters of the peak flow rate (measured in mL/s), the time to reach the peak flow rate (measured in seconds), the flush volume (measured in mL) and the refill volume (measured in mL). Table 4 also includes the average parameter measured based on the averaged results of the integral of a curve represented by rim pressure against time during a 4.8 liter flush cycle used in each of the experiments as measured in inches of $H_2O$●s. The rim pressure against time as plotted for the 4.8 liter flush cycles for each of trapways. The run data is graphically shown for trapways 2 and 5 at each of the jet diameters in the Examples (Examples 22-24 and 31-33) in FIGS. 23 and 24, respectively. The data for the area under the curves for the various plots generated in the manner of FIGS. 23 and 24 is also included in Table 4.

As can be seen in Table 4, sustained rim pressurization was achieved in these Examples which use a generally larger design toilet within the scope of the invention, having a three-inch flush valve and the configurations noted herein, yet operating at a high performance level using only a 4.8 liter flush cycle. Thus, even varying the geometry and size of the parameters within the ranges supports the design relationships in the present invention and the ability of the invention, including a direct jet and pressurized rim to deliver high performance at low flush volumes. Throughout the parameter ranges provided, the above various Inventive Examples demonstrate that performance of the resultant toilet designs can outperform those currently available in terms of bulk removal and cleanliness at reduced flush volumes.

TABLE 4

| Example Number | Jet Diam. (mm) | Trap Number | Trap Diam. (in.) | Flapper Setting | Golf Balls | 350 Poly Balls | Napkins | Ping Pong Balls | Peak Flow Rate (mL/s) | Peak Time (s) | Flush Volume (mL) | Integral of Pressure v. Time Plot (in. $H_2O \cdot s$) |
|---|---|---|---|---|---|---|---|---|---|---|---|---|
| 19 | 29 | 1 | 1.9375 | 2 | 18 | 296 | 8 | 2 | 2270 | 1.03 | 4940 | 5.15 |
| 20 | 32 | 1 | 1.9375 | 0 | 18 | 309 | 6 | 2 | 2460 | 0.70 | 5200 | 4.28 |
| 21 | 35 | 1 | 1.9375 | 0 | 18 | 250 | 9 | 2 | 2690 | 0.67 | 5530 | 3.55 |
| 22 | 29 | 2 | 2.0625 | 2 | 20 | 337 | 8 | 5 | 2890 | 1.23 | 4440 | 6.15 |
| 23 | 32 | 2 | 2.0625 | 0 | 18 | 336 | 10 | 5 | 2830 | 1.03 | 4700 | 4.70 |
| 24 | 35 | 2 | 2.0625 | 0 | 20 | 324 | 10 | 5 | 3100 | 0.73 | 4970 | 3.95 |
| 25 | 29 | 3 | 2.1875 | 2 | 14 | 308 | 9 | 6 | 2730 | 1.58 | 4450 | 6.03 |
| 26 | 32 | 3 | 2.1875 | 0 | 18 | 312 | 9 | 4 | 2870 | 1.26 | 4630 | 4.88 |
| 27 | 35 | 3 | 2.1875 | 0 | 18 | 324 | 9 | 5 | 2860 | 1.03 | 5000 | 4.13 |
| 28 | 29 | 4 | 1.9375 | 2 | 22 | 345 | 9 | 6 | 2880 | 1.13 | 4550 | 6.15 |
| 29 | 32 | 4 | 1.9375 | 0 | 22 | 328 | 12 | 6 | 2860 | 0.96 | 4810 | 4.98 |
| 30 | 35 | 4 | 1.9375 | 0 | 20 | 330 | 13 | 5 | 3110 | 0.78 | 5030 | 4.18 |
| 31 | 29 | 5 | 2.0625 | 2 | 18 | 335 | 11 | 4 | 2980 | 1.27 | 4660 | 5.38 |
| 32 | 32 | 5 | 2.0625 | 0 | 20 | 323 | 11 | 4 | 2880 | 1.18 | 4870 | 4.30 |
| 33 | 35 | 5 | 2.0625 | 0 | 18 | 316 | 10 | 5 | 2880 | 1.02 | 5260 | 3.90 |
| 34 | 29 | 6 | 2.1875 | 2 | 16 | 321 | 8 | 4 | 2900 | 1.41 | 4510 | 6.08 |
| 35 | 32 | 6 | 2.1875 | 0 | 18 | 287 | 10 | 4 | 2870 | 1.36 | 4690 | 4.40 |
| 36 | 35 | 6 | 2.1875 | 0 | 18 | 302 | 8 | 3 | 2750 | 1.18 | 4930 | 4.03 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A siphonic, gravity-powered toilet having a toilet bowl assembly, the toilet bowl assembly comprising a toilet bowl assembly inlet in fluid communication with a source of fluid, a toilet bowl having a rim around an upper perimeter thereof and defining a rim channel, the rim having an inlet port and at least one rim outlet port, wherein cross-sectional area of the rim inlet port is greater than or equal to about 250% of the total cross-sectional area of the at least one rim outlet port, wherein the rim channel inlet port is in fluid communication with the toilet bowl assembly inlet, a bowl outlet in fluid communication with a sewage outlet, and a direct-fed jet in fluid communication with the toilet bowl assembly inlet for receiving fluid from the source of fluid and the bowl outlet for discharging fluid, wherein the toilet is capable of operating at a flush volume of no greater than about 6.0 liters and the water exiting the at least one rim outlet port is pressurized such that an integral of a curve representing rim pressure plotted against time during a flush cycle exceeds 3 in. $H_2O \cdot s$ for a 6.0 liter flush volume, and and wherein a cross-sectional area ($A_{jop}$) of the jet outlet is about 0.6to about 5 square inches.

2. The siphonic, gravity-powered toilet according to claim 1, wherein the toilet is capable of providing flow from the at least one rim outlet port which is pressurized in a sustained manner for a period of time.

3. The siphonic, gravity-powered toilet according to claim 2, wherein the period of time is at least 1 second.

4. The siphonic, gravity-powered toilet according to claim 2, wherein the toilet is capable of providing the sustained pressurized flow from the at least one rim outlet port generally simultaneously with flow through the direct-fed jet.

5. The siphonic, gravity-powered toilet according to claim 1, wherein an integral of a curve representing rim pressure plotted against time during a flush cycle exceeds 5 in. $H_2O \cdot s$ for a 6.0 liter flush volume.

6. The siphonic, gravity-powered toilet according to claim 1, wherein the toilet is capable of operating at a flush volume of no greater than about 4.8 liters.

7. The siphonic, gravity-powered toilet according to claim 6, wherein the water exiting the at least one rim outlet port is pressurized such that an integral of a curve representing rim pressure plotted against time during a flush cycle exceeds 3 in. $H_2O \cdot s$ for a 4.8 liter flush volume.

8. The siphonic, gravity-powered toilet according to claim 1, wherein the toilet bowl assembly further comprises a primary manifold in fluid communication with the toilet bowl assembly inlet capable of receiving fluid from the toilet bowl assembly inlet, the primary manifold also in fluid communication with the rim channel and the direct-fed jet for directing fluid from the toilet bowl assembly inlet to the rim channel and the direct-fed jet, wherein the primary manifold has a cross-sectional area ($A_{pm}$);

wherein the direct-fed jet has an inlet port having a cross-sectional area ($A_{jip}$) and a jet channel extending between the direct-fed jet inlet port and the direct-fed jet outlet port; and wherein the rim channel has an inlet port having a cross-sectional area ($A_{rip}$) and the at least one outlet port has a total cross-sectional area ($A_{rop}$), wherein:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

9. The siphonic, gravity-powered toilet according to claim 1, wherein the assembly further comprises a primary manifold capable of receiving fluid from the toilet bowl assembly inlet, the primary manifold being in fluid communication with the rim channel and the direct fed jet for directing fluid from the bowl inlet to the rim channel and the direct fed jet, and the at least one rim outlet port that has a total cross-sectional area, and wherein a cross-sectional area of the primary manifold is greater than or equal to about 150% of the sum of the cross sectional area of the direct-fed jet outlet port and the total cross-sectional area of the at least one rim outlet port.

10. The siphonic, gravity-powered toilet according to claim 1, wherein the toilet further comprises a mechanism that enables operation of the toilet using at least two different flush volumes.

11. The toilet according to claim 1, wherein toilet bowl assembly has a longitudinal axis extending in a direction transverse to a plane defined by the rim of the toilet bowl, and the primary manifold extends in a direction generally transverse to the longitudinal axis of the toilet bowl.

12. The siphonic, gravity-powered toilet according to claim 1, wherein a cross-sectional area ($A_{jim}$) of a jet inlet port of the direct fed is 2.5 to about 15 square inches, a cross-sectional area ($A_{rip}$) of the rim inlet port is about 1.5 to about 15 square inches, and a cross-sectional area ($A_{rop}$) of the at least one rim outlet ports is about 0.3 to about 5 square inches.

13. A siphonic, gravity-powered toilet having a toilet bowl assembly, the toilet bowl assembly, the toilet bowl assembly comprising a toilet bowl assembly inlet in communication with a fluid source, a toilet bowl defining an interior space therein for receiving fluid, a rim extending along an upper periphery of the toilet bowl and defining a rim channel, wherein the rim has a rim channel inlet port and at least one rim channel outlet port, wherein the cross-sectional area of the rim inlet port is greater than or equal to about 250% of the total cross-sectional area of the at least one rim outlet port, wherein the rim channel inlet port is in fluid communication with the toilet bowl assembly inlet and the at least one rim channel outlet port is configured so as to allow fluid flowing through the rim channel to enter the interior space of the toilet bowl, a bowl outlet in fluid communication with a sewage outlet and a direct-fed jet having an inlet port and an outlet port, wherein the direct-fed jet inlet port is in fluid communication with the toilet bowl assembly inlet for introducing fluid into a lower portion of the interior of the bowl, wherein the toilet bowl assembly is configured so that the rim channel and the direct-fed jet are capable of introducing fluid into the bowl in a sustained pressurized manner and wherein a cross-sectional area ($A_{jop}$) of the jet outlet port is about 0.6 to about 5 square inches.

14. The siphonic, gravity-powered toilet according to claim 13, wherein the toilet bowl assembly further comprises a primary manifold in fluid communication with the toilet bowl assembly inlet capable of receiving fluid from the toilet bowl assembly inlet, and the primary manifold also in fluid communication with the inlet port of the rim channel and the inlet port of the direct-fed jet for directing fluid from the toilet bowl assembly inlet to the rim channel and to the direct-fed jet, wherein the primary manifold has a cross-sectional area ($A_{pm}$);

wherein the inlet port of the direct-fed jet has a cross-sectional area ($A_{jip}$) and wherein the inlet port of the rim channel has a cross-sectional area ($A_{rip}$) and the at least one outlet port has a total cross-sectional area ($A_{rop}$), wherein:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

15. The siphonic, gravity-powered toilet according to claim 14, wherein $A_{pm}$ is about 3 to about 20 square inches, $A_{jip}$ is about 2.5 to about 15 square inches, $A_{rip}$ is about 1.5 to about 15 square inches, and $A_{rop}$ is about 0.3 to about 5 square inches.

16. The siphonic, gravity-powered toilet according to claim 15, wherein $A_{pm}/(A_{rop}+A_{jop})$ is about 150% to about 2300% and $A_{rip}/A_{rop}$ is about 250% to about 5000%.

17. The siphonic, gravity-powered toilet according to claim 15, wherein $A_{pm}$ is about 3.5 to about 15 square inches, $A_{jip}$ is about 4 to about 12 square inches, $A_{jop}$ is about 0.85 to about 3.5 square inches, $A_{rip}$ is about 2 to about 12 square inches, and $A_{rop}$ is about 0.4 to about 4 square inches.

18. The siphonic, gravity-powered toilet according to claim 13, wherein the assembly further comprises a primary manifold capable of receiving fluid from the toilet bowl assembly inlet, the primary manifold being in fluid communication with the rim channel and the direct fed jet for directing fluid from the bowl inlet to the rim channel and the direct fed jet, and the at least one rim outlet port that has a total cross-sectional area, and wherein a cross-sectional area of the primary manifold is greater than or equal to about 150% of the sum of the cross-sectional area of the direct-fed jet outlet port and the total cross-sectional area of the at least one rim outlet port.

19. The siphonic, gravity-powered toilet according to claim 13, wherein $A_{pm}/(A_{rop}+A_{jop})$ is about 150% to about 1200% and $A_{rip}/A_{rop}$ is about 250% to about 3000%.

20. The siphonic, gravity-powered toilet according to claim 13, wherein the toilet further comprises a mechanism that enables operation of the toilet using at least two different flush volumes.

21. A siphonic, gravity-powered toilet having a toilet bowl assembly, the toilet bowl assembly, the toilet bowl assembly comprising a toilet bowl assembly inlet for fluid communication with a source of fluid, a toilet bowl having a rim around an upper perimeter thereof and defining a rim channel, the rim having an inlet port and at least one rim outlet port, wherein the cross sectional area of the rim inlet port is greater than or equal to about 250% of the total cross-sectional area of the at least one rim outlet port, and wherein the rim channel inlet port is in fluid communication with the toilet bowl assembly inlet, a bowl outlet in fluid communication with a sewage outlet, and a direct-fed jet in fluid communication with the toilet bowl assembly inlet for receiving fluid from the source of fluid and the bowl outlet for discharging fluid, wherein the toilet is capable of operating at a flush volume of no greater than about 6.0 liters and the water exiting the at least one rim outlet port is pressurized, and wherein the toilet bowl assembly further comprises a primary manifold in fluid communication with the toilet bowl assembly inlet capable of receiving fluid from the toilet bowl assembly inlet, the primary manifold also in fluid communication with the rim channel and the direct-fed jet for directing fluid from the toilet bowl assembly inlet to the rim channel and the direct-fed jet, wherein the primary manifold has a cross-sectional area ($A_{pm}$);

wherein the direct-fed jet has an inlet port having a cross-sectional area ($A_{jip}$) and an outlet port having a cross-sectional area ($A_{jop}$) and further comprises a jet channel extending between the direct-fed jet inlet port and the direct-fed jet outlet port; and wherein the rim channel has an inlet port having a cross-sectional area ($A_{rip}$) and the at least one outlet port has a total cross-sectional area ($A_{rop}$), wherein:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop} \quad \text{(IV)}$$

and wherein $A_{jop}$ is about 0.6 to about 5square inches.

22. The siphonic, gravity-powered toilet according to claim 21, wherein the toilet is capable of providing flow from the at least one rim outlet port which is pressurized in a sustained manner for a period of time.

23. The siphonic, gravity-powered toilet according to claim 22, wherein the period of time is at least 1 second.

24. The siphonic, gravity-powered toilet according to claim 21, wherein the toilet is capable of providing the sustained pressurized flow from the at least one rim outlet port generally simultaneously with flow through the direct-fed jet.

25. The siphonic, gravity-powered toilet according to claim 21, wherein an integral of a curve representing rim pressure plotted against time during a flush cycle exceeds 3 in. $H_2O\cdot s$ for a 6.0 liter flush volume.

26. The siphonic, gravity-powered toilet according to claim 21, wherein the toilet is capable of operating at a flush volume of not greater than about 4.8 liters.

27. The siphonic, gravity-powered toilet according to claim 21, wherein an integral of a curve representing rim pressure plotted against time during a flush cycle exceeds 3 in. $H_2O\cdot s$ for a 4.8 liter flush volume.

28. The siphonic, gravity-powered toilet according to claim 21, wherein $A_{pm}$ is about 9 to about 15 square inches, $A_{jip}$ is about 5 to about 12 square inches, $A_{jop}$ is about 1 to about 3.5 square inches, $A_{rip}$ is about 3 to about 12 square inches, and $A_{rop}$ is about 0.45 to about 4 square inches.

29. The siphonic, gravity-powered toilet according to claim 28, wherein $A_{pm}/(A_{rop}+A_{jop})$ is about 500% to about 1200% and $A_{rip}/A_{rop}$ is about 700% to about 3000%.

30. The siphonic, gravity-powered toilet according to claim 28, wherein $A_{pm}$ is about 10.78 square inches, $A_{jip}$ is about 5.26 square inches, $A_{jop}$ is about 1.10 square inches, $A_{rip}$ is about 3.87 square inches, and $A_{rop}$ is about 0.49 inches.

31. The method according to claim 30, wherein the toilet is capable of operating at a flush volume of not greater than about 4.8 liters.

32. The method according to claim 31, wherein the integral of a curve representing rim pressure plotted against time during a flush cycle exceeds 3 in. $H_2O\cdot s$ for a 4.8 liter flush volume.

33. The siphonic, gravity-powered toilet according to claim 30, wherein $A_{pm}/(A_{rop}+A_{jop})$ is about 678% and $A_{rip}/A_{rop}$ is about 790%.

34. In a siphonic, gravity-powered toilet having a toilet bowl assembly, the assembly comprising a toilet bowl, a direct-fed jet and a rim defining a rim channel and having at least one rim opening, wherein fluid is introduced into the bowl through the direct-fed jet and through the at least one rim opening and wherein the direct fed jet has an outlet port ($A_{jop}$) that is about 0.6 to about 5 square inches, a method for providing a toilet capable of operating at a flush volume of no greater than about 6.0 liters, the method comprising:

introducing fluid from a fluid source through a toilet bowl assembly inlet and into the direct-fed jet and into the rim channel so that fluid flows into an interior of the toilet bowl from the direct-fed jet under pressure and from the at least one rim opening in a sustained pressurized manner such that an integral of a curve representing rim pressure plotted against time during a flush cycle exceeds 3 in. $H_2O\cdot s$ for a 6.0 liter flush.

35. The method according to claim 34, wherein the integral of a curve representing rim pressure plotted against time during a flush cycle exceeds 5 in. $H_2O\cdot s$ for a 6.0 liter flush volume.

36. The method according to claim 34, wherein the toilet bowl assembly further comprises a primary manifold in fluid communication with the toilet bowl assembly inlet, the primary manifold capable of receiving fluid from the toilet bowl assembly inlet, the primary manifold being in fluid communication with the rim channel and the direct-fed jet for directing fluid from the bowl inlet to the rim channel and the direct-fed jet, wherein the primary manifold has a cross-sectional area ($A_{pm}$);

wherein the direct-fed jet has an inlet port having a cross-sectional area ($A_{jip}$); and wherein the rim channel has an inlet port having a cross-sectional area ($A_{rip}$) and the at least one rim opening is at least one rim outlet port has a total cross-sectional area ($A_{rop}$), wherein the method further comprises configuring the bowl so that:

$$A_{pm}>A_{jip}>A_{jop} \quad \text{(I)}$$

$$A_{pm}>A_{rip}>A_{rop} \quad \text{(II)}$$

$$A_{pm}>1.5\cdot(A_{jop}+A_{rop}) \text{ and} \quad \text{(III)}$$

$$A_{rip}>2.5\cdot A_{rop}. \quad \text{(IV)}$$

37. The method according to claim 34, wherein the assembly further comprises a primary manifold capable of receiving fluid from the toilet bowl assembly inlet, the primary manifold being in fluid communication with the rim channel and the direct fed jet for directing fluid from the bowl inlet to the rim channel and the direct fed jet, and the at least one rim opening is at least one rim outlet port that has a total cross-sectional area, and wherein a cross-sectional area of the primary manifold is greater than or equal to about 150% of the sum of the cross-sectional area of the direct-fed jet outlet port and the total cross-sectional area of the at least one rim outlet port.

38. The method according to claim 37, wherein the assembly comprises a rim inlet port and cross-sectional area of the rim inlet port is greater than or equal to about 250% of the total cross-sectional area of the at least one rim outlet port.

39. The method according to claim 34, wherein a cross-sectional area ($A_{jim}$) of a jet inlet port of the direct fed is 2.5 to about 15 square inches, a cross-sectional area ($A_{rip}$) of the rim inlet port is about 1.5 to about 15 square inches, and a cross sectional area ($A_{rop}$) of the at least one rim outlet ports is about 0.3 to about 5 square inches.

* * * * *